US007883589B2

(12) United States Patent
Oishi

(10) Patent No.: US 7,883,589 B2
(45) Date of Patent: Feb. 8, 2011

(54) FREE-CUTTING COPPER ALLOY CONTAINING VERY LOW LEAD

(75) Inventor: Keiichiro Oishi, Yao (JP)

(73) Assignee: Mitsubishi Shindoh Co., Ltd., Tokyo (JP)

( * ) Notice: Subject to any disclaimer, the term of this patent is extended or adjusted under 35 U.S.C. 154(b) by 808 days.

(21) Appl. No.: 11/420,623

(22) Filed: May 26, 2006

(65) Prior Publication Data

US 2007/0062615 A1 Mar. 22, 2007

Related U.S. Application Data

(63) Continuation-in-part of application No. PCT/JP2005/018206, filed on Sep. 22, 2005.

(51) Int. Cl.
*C22C 9/04* (2006.01)

(52) U.S. Cl. ..... 148/434

(58) Field of Classification Search ..... 420/490, 420/477; 148/434

See application file for complete search history.

(56) References Cited

U.S. PATENT DOCUMENTS

| | | | | |
|---|---|---|---|---|
| 1,954,003 | A | 4/1934 | Vaders | |
| 2,315,700 | A | 4/1941 | Hehemann | |
| 4,055,445 | A | 10/1977 | Pops | |
| 4,676,848 | A | 6/1987 | Ruchel et al. | |
| 5,582,281 | A | 12/1996 | Nakashima et al. | |
| 5,658,401 | A | 8/1997 | Gaag et al. | |
| 5,942,056 | A | 8/1999 | Singh | |
| 6,413,330 | B1 | 7/2002 | Oishi | |
| 6,419,766 | B1 | 7/2002 | Ikemiya et al. | |
| 7,056,396 | B2 | 6/2006 | Oishi | |
| 7,354,489 | B2 | 4/2008 | Hofmann et al. | |
| 2002/0006351 | A1 * | 1/2002 | Sugawara et al. | 420/477 |
| 2002/0159912 | A1 * | 10/2002 | Oishi | 420/477 |
| 2004/0159375 | A1 | 8/2004 | Yamagishi | |
| 2004/0234411 | A1 | 11/2004 | Hofmann et al. | |

FOREIGN PATENT DOCUMENTS

| | | | |
|---|---|---|---|
| CA | 1243226 | A | 10/1988 |
| CH | 148824 | | 10/1931 |
| DE | 1558470 | A1 | 3/1970 |
| DE | 3427740 | A1 | 2/1986 |
| DE | 4139063 | A1 | 6/1993 |

(Continued)

OTHER PUBLICATIONS

S. Kuyucak and M. Sahoo, A Review of the Machinability of Copper-Base Alloys, Canadian Quarterly, vol. 35, No. 1, pp. 1-15, 1996.

(Continued)

*Primary Examiner*—Melvin C Mayes
*Assistant Examiner*—Stefanie Cohen
(74) *Attorney, Agent, or Firm*—Griffin & Szipl, P.C.

(57) ABSTRACT

The free-cutting copper alloy according to the present invention contains a greatly reduced amount of lead in comparison with conventional free-cutting copper alloys, but provides industrially satisfactory machinability. The free-cutting alloys comprise 71.5 to 78.5 percent, by weight, of copper, 2.0 to 4.5 percent, by weight, of silicon, 0.005 percent up to but less than 0.02, by weight, of lead, and the remaining percent, by weight, of zinc.

16 Claims, 11 Drawing Sheets

FOREIGN PATENT DOCUMENTS

| | | | |
|---|---|---|---|
| EP | 61133357 | | 6/1986 |
| EP | 10081926 | | 3/1998 |
| EP | 09143598 | | 6/1998 |
| EP | 0947592 | A1 | 10/1999 |
| EP | 1 502 965 | A1 | 2/2005 |
| GB | 359570 | | 10/1931 |
| GB | 1443090 | | 7/1976 |
| HU | 117048 | | 10/1937 |
| JP | 49-009296 | | 3/1974 |
| JP | 56-009347 | A | 1/1981 |
| JP | 56-096040 | A | 8/1981 |
| JP | 61-133357 | A2 | 6/1986 |
| JP | 62-274036 | A2 | 11/1987 |
| JP | 62-297429 | A2 | 12/1987 |
| JP | 03-068731 | | 3/1991 |
| JP | 3-68732 | A2 | 3/1991 |
| JP | 3-68733 | A | 3/1991 |
| JP | 03-110042 | A | 5/1991 |
| JP | 4-224645 | A2 | 8/1992 |
| JP | 4-246141 | A2 | 9/1992 |
| JP | 7-310133 | A2 | 11/1995 |
| JP | 08120369 | | 5/1996 |
| JP | 09-143598 | A | 6/1997 |
| JP | 9-316570 | | 12/1997 |
| JP | 10-81926 | A | 3/1998 |
| JP | 10-287921 | A2 | 10/1998 |
| JP | 2000-119774 | | 4/2000 |
| JP | 2000-119775 | A | 4/2000 |
| JP | 2002-030364 | A | 1/2002 |
| TF | 148824 | A | 10/1931 |
| WO | 9401591 | A1 | 1/1994 |
| WO | 9810106 | A1 | 3/1998 |
| WO | 9810105 | A1 | 12/1998 |
| WO | 9810106 | A1 | 12/1998 |

OTHER PUBLICATIONS

International Search Report Issued in the Corresponding Application PCT/JP2005/018206, Completed Apr. 26, 2006 and Mailed Jun. 8, 2006.

Mannheim, R et al., Silicon Brass: An Alternative for Lead-Free Faucets and Fittings, Congresso Anual, Volume Date 1997, 52nd, 5012-5032.

R. Mannheim, Laton Al Silicio: Una Alternativa A Las Griferias Y Fittings Sin Polmo, Second International Conference on Metallurgic and Materials Technology—Sao Paulo/19, pp. 1-4.

XP-002223300, Silicon Bronze, Properties of Cast Copper Alloys/545.

1993 Annual Book of ASTM Standards, Section 2, 10-288590, pp. 1-5.

Standards Handbook, Part 2 Alloy Data, Wrought Copper and Copper Alloy Mill Products, Eighth Edition, 1985, pp. 1-3.

Notice of Reason for Rejection, Serial No. JP-SS98101, Jan. 22, 2002.

Notice of Reason for Rejection, Serial No. JP-SS98102, Jan. 29, 2002.

Notice, Serial No. JP-SS98101, Jan. 15, 2002.

Ricjes, McKenzie & Herbert LLP, 2,303,512, Sambo Copper Alloy Co., Ltd., Aug. 17, 2004.

Communication Pursuant to Article 96(2) EPC, Application No. 989530704-2122, Jun. 10, 2003.

European Search Report, EP04077560, Completed Nov. 18, 2004.

European Search Reoprt, EP04077561, Completed Dec. 14, 2004.

Hyuck Mo Lee et al., Thermodynamic Prediction of Interface Phases at Cu/Solder Joints, Journal of Electronic Materials, vol. 27, No. 11, 1998.

Jamie Yeakle, Ternary Phase Diagrams, http://www.sv.vt.edu/classes/MSE0294_NoteBook/96ClassProj/exp . . . , pp. 1-3.

Mannheim et al., XP-002223301, Silicon Brass: an alternative for lead-free faucets and fittings, 5012-5032, 1997.

Metals Handbook vol. 2—Properties and Selection: Nonferrous Alloys and Special-Purpose Materials, 10th Edition, ASM International, 1991, pp. 217-218.

English translation of the International Preliminary Report on Patentability in corresponding application No. PCT/JP2005/018206 issued Mar. 26, 2008.

Anne Marie Helmenstine, What Makes Lead Poisonous?, at http://chemistry.about.com/od/howthingsworkfaqs/f/leadpoisoning.htm, downloaded Feb. 24, 2010, 2 pages.

Agency for Toxic Substances and Disease Registry, Lead, CAS# 7439-92-1.

Mima, Genjiro; Hasegawa, Masaharu, Diagram of copper-silicon-zinc alloys. II, Technology Reports of the Osaka University (1957), 7, 385-97.

Mehi, Robert F., Atlas of Microstructures of Industrial Alloys, p. 291, 294 and 295, 8th Edition, vol. 7, American Society for Metals, Metals Park, Ohio 44073, 1972.

1994 Annual Book of ASTM Standards, p. 815, Nonferrous Metal Products, vol. 03.01 Copper and Copper Alloys, PA.

JIS, 3, p. 524, 2004, JP.

Metallurgical Aspects of the Control of Quality in Non-Ferrous castings, A Symposium held in London on the occasion of the Annual General Meeting of the Institute, Institute of Metals Monograph and Report Series, No. 22, 1957.

ASM Specialty Handbook, Properties of Cast Copper alloys, "C87500, C87800, 82Cu-4Si-14Zn, Silicon Brass," p. 545, 2001.

H.M. Lee et al., Thermodynamic Prediction of Interface Phases at Cu/Solder Joints, 27 J. Electronic Materials 1161, 1162 (1998).

Metals Handbook, 8th Edition, vol. 8, "Metallography, Structures and Phase Diagrams," p. 431, 1973.

Jamie Yeakle, www.sv.vt.edu/classes/MSE2094_Notebook/96ClassProj/exp . . . , last downloaded on May 3, 2006.

Properties and Selection: Iron, Steels, and High-Performance Alloys, vol. 1, Tenth Edition, p. 909, 1990.

American Society for Metals, Metals Handbook (8TH ed.), pp. 275, 294, 301, 394, 408, 413 and 425, 1968.

Metals Handbook pp. 319-321 (10TH ed.), 1990.

1994 Annual Book of ASTM Standards, pp. 809-810, "Standard Designations for Copper and Copper Alloys".

Annual Book of ASTM Standards 2000, vol. 02.01, Section 2, Nonferrous Metal Products, p. 884.

Metallurgical Aspects of the Control of Quality in Non-Ferrous Castings, p. 64, 1957.

* cited by examiner

FREE-CUTTING COPPER ALLOY CONTAINING VERY LOW LEAD

This is a Continuation-in-Part Application in the United States of International Patent Application No. PCT/JP2005/18206 filed Sep. 22, 2005. The entire disclosure of the above-identified international patent application is hereby incorporated by reference.

CROSS-REFERENCE TO RELATED APPLICATIONS

This application is related to U.S. patent application Ser. No. 09/983,029, filed Oct. 27, 1999, the entire disclosure of which is incorporated herein by reference, which in turn is a continuation-in-part of U.S. patent application Ser. No. 09/403,834, filed Oct. 27, 1999, the entire disclosure of which is incorporated herein by reference, which application claims priority from Japanese Application No. 10-287921, filed Oct. 9, 1998, the entire disclosure of which is incorporated herein by reference. This application is further related to U.S. patent application Ser. No. 09/987,173 filed on Nov. 13, 2001, now U.S. Pat. No. 6,413,330, the entire disclosure of which is incorporated by reference, which application is a continuation-in-part of U.S. patent application Ser. No. 09/555,881, filed Jun. 8, 2000, the entire disclosure of which is incorporated herein by reference, which application claims priority from Japanese Application No. 10-288590, filed Oct. 12, 1998, the entire disclosure of which is incorporated herein by reference.

BACKGROUND OF THE INVENTION

1. Field of the Invention

The present invention relates to free-cutting copper alloys, such as those used in all kinds of industries, but especially to alloys used in the field of providing potable water for human consumption.

2. Related Art

Among the copper alloys with a good machinability are bronze alloys such as those having the JIS designation H5111 BC6 and brass alloys such as those having the JIS designations H3250-C3604 and C3771. These alloys are enhanced in machinability with the addition of 1.0 to 6.0 percent, by weight, of lead so as to give industrially satisfactory results as easy-to-work copper alloys. Because of their excellent machinability, those lead-containing copper alloys have been an important basic material for a variety of articles such as city water faucets and water supply/drainage metal fittings and valves.

In those conventional free-cutting copper alloys, lead does not form a solid solution in the matrix but disperses in granular form, thereby improving the machinability of those alloys. To produce the desired results, lead has, heretofore, had to be added in as much as 2.0 or more percent by weight. If the addition of lead in such alloys is less than 1.0 percent by weight, chippings will be spiral in form, such as shown in FIG. 1G. Spiral chippings cause various troubles such as, for example, tangling with the cutting tool. If, on the other hand, the content of lead is 1.0 or more percent by weight and not larger than 2.0 percent by weight, the cut surface will be rough, though that will produce some results such as reduction of cutting resistance. It is usual, therefore, that lead is added to an extent of not less than 2.0 percent by weight. Some expanded copper alloys in which a high degree of cutting property is required are mixed with some 3.0 or more percent by weight of lead. Further, some bronze castings have a lead content of as much as some 5.0 percent, by weight. The alloy having the JIS designation H 5111 BC6, for example, contains some 5.0 percent by weight of lead.

In alloys containing a few percent lead, fine lead particles are dispersed in the metal structure. During the cutting process, stress can be concentrated on these fine, soft lead particles. Consequently, the chips produced when cutting are smaller and the cutting force is lower. Lead particles act as a chip-breaker under these circumstances.

Meanwhile, when 2.0 to 4.5% Si is added to Cu—Zn alloys under a given composition range and production conditions, there appears in the metal structure one or more of Si-rich κ, γ, μ, or β phases apart from the alpha phase. Among these phases, κ, γ, and μ are hard and have totally different properties from Pb. However, when being cut, stress concentrates on the area where these three phases are present so these phases also act as chip-breakers, thereby lowering the cutting force required. This means that although Pb and κ, γ, and μ phases generated in a Cu—Zn—Si alloy have little or nothing in common in their properties and/or characteristics, they all break chips, and as a result, reduce the required cutting force.

Even so, improved machinability of Cu—Zn—Si alloys having κ, γ, and μ phases is not sufficient enough, in some respects, as compared to C83600 (Leaded Red Brass), C36000 (Free-Cutting Brass), and C37700 (Forging Brass) which contain 5%, 3%, and 2% lead, by weight, respectively.

The application of lead-mixed alloys has been greatly limited in recent years, because lead contained therein is harmful to humans as an environmental pollutant. That is, the lead-containing alloys pose a threat to human health and environmental hygiene because lead finds its way into metallic vapor that is generated in the steps of processing such alloys at high temperatures, such as during melting and casting. There is also a danger that lead contained in the water system metal fittings, valves, and so on made of those alloys will dissolve out into drinking water.

For these reasons, the United States and other advanced nations have been moving in recent years to tighten the standards for lead-containing copper alloys to drastically limit the permissible level of lead in copper alloys. In Japan, too, the use of lead-containing alloys has been increasingly restricted, and there has been a growing call for the development of free-cutting copper alloys with a low lead content. Needless to say, it is desirable to reduce lead content as much as possible.

Recent advances have reduced lead content in free-cutting copper alloys to as low as 0.02%, for example, as described in US 2002-0159912 A1 (publication of U.S. application Ser. No. 10/287,921). However, in view of strong public concerns over lead content, it is desirable to reduce lead content even further. Although lead-free alloys are known in the art, for example, as described in U.S. Pat. No. 6,413,330, the present inventor has found that certain advantages exist in having small amounts of lead in the alloy.

SUMMARY OF THE INVENTION

It is an object of the present invention to provide a free-cutting copper alloy that contains an extremely small amount (i.e., 0.005 percent and up to but less than 0.02 percent, by weight) of lead as a machinability-improving element. It is an object to provide an alloy that is excellent in machinability, yet can be used as a safe substitute for conventional easy-to-cut copper alloys, which have a relatively large lead content. It is an object to provide an alloy that presents no environmental hygienic problems while permitting the recycling of chippings, thus providing a timely answer to the mounting call for the restriction of lead-containing products. The present invention achieves these results in certain preferred embodiments by recognizing and taking advantage of a synergistic effect of combining κ, γ, and μ phases with slight amounts of Pb on alloy machinability.

It is an another object of the present invention to provide a free-cutting copper alloy that has high corrosion resistance coupled with excellent machinability and is suitable as basic material for cutting works, forgings, castings and others, thus having a very high practical value. The cutting works, forgings, castings, and so on, in which the present alloy can be employed, include city water faucets, water supply/drainage metal fittings, water meters, sprinklers, joints, water stop valves, valves, stems, hot water supply pipe fittings, shaft and heat exchanger parts.

It is yet another object of the present invention to provide a free-cutting copper alloy with a high strength and wear resistance coupled with an easy-to-cut property that is suitable as basic material for the manufacture of cutting works, forgings, castings, and other uses requiring high strength and wear resistance such as, for example, bearings, bolts, nuts, bushes, gears, sewing machine parts, cylinder parts, valve seats, synchronizer rings, slide members and hydraulic system parts, and which therefore is of great practical value.

It is a further object of the present invention to provide a free-cutting copper alloy with an excellent high-temperature oxidation resistance combined with an easy-to-cut property, which is suitable as basic material for the manufacture of cutting works, forgings, castings, and other uses where a high thermal oxidation resistance is essential, e.g. nozzles for kerosene oil and gas heaters, burner heads, and gas nozzles for hot-water dispensers, and which therefore has great practical value.

It is a further object of the present invention to provide a free-cutting copper alloy with excellent machinability and high impact resistance, which is suitable as basic material for the manufacture of products that need to be made of impact resistant material because they undergo a caulking process after a cutting process, such as tube connectors called "nipples," cable connectors, fittings, clamps, metal hinges for furniture, automobile sensor parts, and the like.

On or more of the above objects of the present inventions are achieved by provision of the following copper alloys.

First Invention Alloy

A free-cutting copper alloy with an excellent easy-to-cut feature which is composed of 71.5 to 78.5 percent, by weight, of copper, 2.0 to 4.5 percent, by weight, of silicon, 0.005 percent up to but less than 0.02 percent, by weight, of lead and the remaining percent, by weight, of zinc, wherein the percent by weight of copper and silicon in the copper alloy satisfy the relationship $61-50Pb \leqq X-4Y \leqq 66+50Pb$, wherein Pb is the percent, by weight, of lead, X is the percent, by weight, of copper, and Y is the percent, by weight, of silicon. For purpose of simplicity, this copper alloy will be hereinafter called the "first invention alloy."

Lead does not form a solid solution in the matrix but instead disperses in granular form, as lead particles, to improve machinability. Even small amounts of lead particles in a copper alloy improves machinability. On the other hand, silicon improves the easy-to-cut property by producing a gamma phase and/or a kappa phase (in some cases, a mu phase) in the structure of metal. Silicon and lead are the same in that they are effective in improving machinability, though they are quite different in their contribution to other properties of the alloy. On the basis of that recognition, silicon is added to the first invention alloy so as to bring about a high level of machinability to meet industrial requirements while making it possible to greatly reduce the lead content in the alloy, thereby eliminating risk of lead toxicity to humans. That is, the first invention alloy is improved in machinability through formation of a gamma phase and a kappa phase with the addition of silicon. Thus, the first invention alloy has industrially satisfactory machinability, which means that the invention alloy, when cut at high-speed under dry conditions, has machinability equivalent to the machinability of conventional free-cutting copper alloys. In other words, the first invention alloy has improved machinability through the formation of gamma, kappa, and mu phases due to the addition of silicon, as well as improved machinability due to the addition of very low amounts of lead (i.e., lead content of about 0.005 percent, by weight, to up to but less than 0.02 percent, by weight).

With the addition of less than 2.0 percent by weight of silicon, the metal alloy cannot form a gamma phase or a kappa phase sufficient enough to secure industrially satisfactory machinability. With an increase in the addition of silicon, machinability improves. But with the addition of more than 4.5 percent by weight of silicon, machinability will not go up in proportion. The problem is, however, that silicon is high in melting point and low in specific gravity and also is liable to oxidize. If unmixed silicon is fed into the furnace in the melting step, silicon will float on the molten metal and is oxidized into oxides of silicon (i.e., silicon oxide), thereby hampering the production of a silicon-containing copper alloy. In producing the ingot of silicon-containing copper alloy, therefore, silicon is usually added in the form of a Cu—Si alloy, which boosts the production cost. As the amount of silicon becomes excessive, the portion of gamma/kappa phases formed becomes too large in the total area of the metal construction. The presence of these phases in excessive amount prevents them from working as stress concentrating areas and makes the alloy harder than necessary. Therefore, it is not desirable to add silicon in a quantity exceeding the saturation point or plateau of machinability improvement, that is, 4.5 percent by weight. An experiment has shown that when silicon is added in the amount of 2.0 to 4.5 percent by weight, it is desirable to hold the content of copper at about 71.5 to 78.5 percent by weight in consideration of its relation to the content of zinc in order to maintain the intrinsic properties of the Cu—Zn alloy. For this reason, the first invention alloy is composed of 71.5 to 78.5 percent by weight of copper and 2.0 to 4.5 percent by weight of silicon, respectively. The addition of silicon improves not only the machinability but also the characteristics of flow of the molten metal in (a) casting, (b) strength, (c) wear resistance, (d) resistance to stress corrosion cracking, and (e) high-temperature oxidation resistance. However, these characteristics are not seen unless the percent by weight of copper and silicon in the first invention alloy satisfies the relationship $61-50Pb \leqq X-4Y \leqq 66+50Pb$, wherein X is the percent, by weight, of copper and Y is the percent, by weight of silicon, and Pb is the percent, by weight, of lead. Also, the ductility and de-zinc-ing corrosion resistance will be improved to some extent.

The addition of lead in the first invention alloy is set at 0.005 percent up to but less than 0.02 percent, by weight, for this reason. In the first invention alloy, a sufficient level of machinability is obtained by adding silicon that has the aforesaid effect of inducing a gamma phase and/or a kappa phase even if the addition of lead is reduced. Yet, lead has to be added to the Cu—Zn alloy in an amount not smaller than 0.005 percent, by weight, if the alloy is to be superior to the conventional free-cutting copper alloy in machinability. On the other hand, the addition of relatively large amounts of lead would have an adverse effect on the properties of the alloy, resulting in a rough surface condition, poor hot workability such as poor forging behavior, and low cold ductility. Meanwhile, it is expected that such a small lead content of less than 0.02 percent by weight will be able to clear governmental lead-related regulations however strictly they are to be stipulated in the future in the advanced nations, including Japan. For this reason, the range of lead added to the alloy is set at 0.005 percent up to but less than 0.02 percent, by weight, in the firsthand also second and third invention alloys, which will be described later. Modifications of the first, second and third invention alloys all include this low lead range, in accordance with the present invention.

Second Invention Alloy

Another embodiment of the present invention is a free-cutting copper alloy, also with an excellent easy-to-cut feature, which is composed of 71.5 to 78.5 percent, by weight, of copper; 2.0 to 4.5 percent, by weight, of silicon; 0.005 percent up to but less than 0.02 percent, by weight, of lead; at least one element selected from among 0.01 to 0.2 percent, by weight, of phosphorus, 0.02 to 0.2 percent, by weight, of antimony, 0.02 to 0.2 percent, by weight, of arsenic, 0.1 to 1.2 percent, by weight, of tin, and 0.1 to 2.0 percent, by weight, of aluminum; and the remaining percent, by weight, of zinc, wherein the percent by weight of copper, silicon, and the other selected element(s), (i.e., phosphorus, antimony, arsenic, tin, aluminum) in the copper alloy satisfy the relationship $61-50Pb \leqq X-4Y+aZ \leqq 66+50Pb$, wherein Pb is the percent, by weight, of lead, X is the percent, by weight, of copper, Y is the percent, by weight, of silicon, and Z is the percent, by weight, of the selected element from among phosphorous, antimony, arsenic, tin and aluminum, and a is a coefficient of the selected element, wherein a is −3 when the selected element is phosphorus, a is 0 when the selected element is antimony, a is 0 when the selected element is arsenic, a is −1 when the selected element is tin, and a is −2 when the selected element is aluminum. This second copper alloy will be hereinafter called the "second invention alloy." The second invention alloy is a free-cutting alloy having excellent corrosion resistance against dezincification, erosion, and so on, as well as having further improved machinability.

Aluminum is effective in facilitating the formation of the gamma phase and works like silicon. That is, if aluminum is added, a gamma phase will be formed and this gamma phase improves the machinability of the Cu—Si—Zn alloy. Aluminum is also effective in improving the strength, wear resistance, and high-temperature oxidation resistance as well as the machinability of the Cu—Si—Zn alloy. Aluminum also helps keep down the specific gravity. If the machinability is to be improved at all from this element, aluminum will have to be added in an amount of at least 0.1 percent by weight. But the addition of more than 2.0 percent by weight does not produce proportional results. Instead, adding more aluminum, in excess of 2.0 percent by weight, lowers the ductility of the metal alloy, since a gamma phase will be formed excessively by such addition, without contributing further to the machinability.

As to phosphorus, it has no property of forming the gamma phase as does aluminum. But, phosphorus does work to uniformly disperse and distribute the gamma phase formed as a result of the addition of silicon, either alone or in combination with aluminum. In this way, the machinability improvement achieved through the formation of gamma phase is further enhanced by the ability of the phosphorous to uniformly disperse and distribute the gamma phase in the metal alloy. In addition to dispersing the gamma phase, phosphorus helps refine the crystal grains in the alpha phase of the matrix, thereby improving hot workability and also strength and resistance to stress corrosion cracking. Furthermore, phosphorus substantially increases the flow of molten metal in casting, as well as dezincification resistance. To produce such results, phosphorus will have to be added in an amount not smaller than 0.01 percent by weight. But if the addition of phosphorous exceeds 0.20 percent by weight, no proportional effect will be obtained. Instead, there would be a decrease in hot forging property and extrudability of the copper metal alloy.

The second invention alloy has, in addition to the first invention alloy, at least one element selected from among 0.01 to 0.2 percent, by weight, of phosphorus, 0.02 to 0.2 percent, by weight, of antimony, and 0.02 to 0.2 percent, by weight, of arsenic, 0.1 to 1.2 percent, by weight, of tin, and 0.1 to 2.0 percent, by weight, of aluminum. As described above, phosphorus disperses the gamma phase uniformly and at the same time refines the crystal grains in the alpha phase of the matrix, thereby improving the machinability and also the corrosion resistance properties (i.e., de-zinc-ification corrosion resistance), forgeability, stress corrosion cracking resistance, and mechanical strength properties of the alloy. The second invention alloy is thus improved in corrosion resistance and other properties through the action of phosphorus, and in machinability mainly by adding silicon. The addition of phosphorus in a very small quantity, that is, 0.01 or more percent by weight, could produce beneficial results. But the addition in more than 0.20 percent, by weight, is not so effective as would be hoped for from the quantity of phosphorous added. On the contrary, the addition of more than 0.20 percent, by weight, of phosphorous would reduce the hot forgeability and extrudability. Meanwhile, arsenic or antimony improves dezincification resistance even with the slight addition of 0.02 or more percent, by weight, which can produce beneficial results.

Tin expedites the formation of gamma phase and, at the same time, works to disperse, and to distribute more evenly, gamma and/or kappa phases formed in the alpha matrix. Thus, tin further improves machinability of Cu—Zn—Si metal alloys. Tin also improves corrosion resistance, especially against erosion corrosion and dezincification corrosion. In order to achieve such positive effects against corrosion, more than 0.1%, by weight, of tin should be added. On the other hand, when the addition of tin exceeds 1.2%, by weight, then the excess tin reduces ductility and the impact value of the invention alloy, so cracks occur easily when cast. Thus, in order to secure the positive effects of added tin, while avoiding the degradation of ductility and impact value, the addition of tin, in accordance with the present invention, is preferably at 0.2 to 0.8%, by weight.

Those observations indicate that the second invention alloy is improved in machinability, and also corrosion resistance and other properties, by adding at least one element selected from among phosphorus, antimony, arsenic (which improve corrosion resistance), tin and aluminum in quantities within the aforesaid limits, in addition to the same quantities of copper and silicon as in the first invention copper alloy. In the second invention alloy, the addition of copper and silicon are set at 71.5 to 78.5 percent, by weight, and 2.0 to 4.5 percent, by weight, respectively—the same level as in the first invention alloy, in which no other machinability improver other than silicon and a small amount of lead is added, because phosphorus works mainly as a corrosion resistance improver like antimony and arsenic.

Third Invention Alloy

A free-cutting copper alloy also with an excellent easy-to-cut feature and with an excellent high strength feature and high corrosion resistance which is composed of 71.5 to 78.5 percent, by weight, of copper; 2.0 to 4.5 percent, by weight, of silicon; 0.005 percent up to but less than 0.02 percent, by weight, of lead; at least one element selected from among 0.01 to 0.2 percent, by weight, of phosphorus, 0.02 to 0.2 percent, by weight, of antimony, 0.02 to 0.15 percent, by weight, of arsenic, 0.1 to 1.2 percent, by weight, of tin, and 0.1 to 2.0 percent, by weight, of aluminum; and at least one element selected from among 0.3 to 4 percent, by weight, of manganese, and 0.2 to 3.0 percent, by weight, of nickel so the total percent, by weight, of manganese and nickel is between 0.3 to 4.0 percent, by weight; and the remaining percent, by weight, of zinc, wherein the percent by weight of copper, silicon, and the selected element(s), (i.e., phosphorous, antimony, arsenic, tin, aluminum, manganese, and nickel), in the copper alloy satisfy the relationship $61-50Pb \leqq X-4Y+aZ \leqq 66+50Pb$, wherein Pb is the percent, by weight, of lead, wherein X is the percent, by weight, of copper, Y is the percent, by weight, of silicon, and Z is the amount in percent, by weight, of the at least one element selected from among phosphorous, antimony, arsenic, tin, aluminum, manganese and nickel, wherein a is a coefficient of the selected element, wherein a is −3 when the selected element is phosphorous, a is 0 when the selected element is antimony, a is 0 when the selected element is arsenic, a is −1 when the selected element is tin, a is −2 when the selected element is aluminum, a is 2.5 when the selected element is manganese, and a is 2.5 when the selected element is nickel. The third copper alloy will be hereinafter called the "third invention alloy." The third invention alloy is a free-cutting copper alloy having high strength, excellent wear resistance and corrosion resistance, as well as improved machinability characteristics.

Manganese and nickel combine with silicon to form intermetallic compounds represented by $Mn_xSi_y$, or $Ni_xSi_y$, which are evenly precipitated in the matrix, thereby raising the wear resistance and strength. Therefore, the addition of manganese and nickel, or either of the two, would improve the high strength feature and wear resistance of the third invention alloy. Such effects will be exhibited if manganese and nickel are added in an amount not smaller than 0.2 percent, by weight, respectively. But the saturation state is reached at 3.0 percent, by weight, in the case of nickel and at 4.0 percent, by weight, in the case of manganese, so even if the addition of manganese and/or nickel is increased beyond that, no proportional improved results will be obtained. The addition of silicon is set at 2.0 to 4.5 percent, by weight, to match the addition of manganese and/or nickel, taking into consideration the consumption of silicon to form intermetallic compounds with those elements, manganese and nickel.

It is also noted that aluminum, and phosphorus, help to reinforce the alpha phase of the matrix, thereby improving the machinability. Phosphorus disperses the alpha and gamma phases, by which the strength, wear resistance, and also machinability, are improved Aluminum also contributes to improving the wear resistance and exhibits its effect of reinforcing the matrix when added in an amount of around 0.1 percent, or more by weight. But if the addition of aluminum exceeds 2.0 percent, by weight, there will be a decrease in ductility due to the excessive amount of gamma phase or beta phase forming, which occurs rather easily. Therefore, the addition of aluminum is set at 0.1 to 2.0 in consideration of desired improvement of machinability. Also, the addition of phosphorus disperses the gamma phase, and at the same time pulverizes the crystal grains in the alpha phase of the matrix, thereby improving the hot workability and also the strength and wear resistance of the copper alloy. Furthermore, phosphorous is very effective in improving the flow of molten metal in casting. Such results will be produced when phosphorus is added in an amount of 0.01 to 0.2 percent, by weight. The content of copper is set at 71.5 to 78.5 percent, by weight, in light of the addition of silicon, and the property of manganese and nickel of combining with silicon.

Aluminum is an element, which improves strength, machinability, wear resistance, and also high-temperature oxidation resistance. Silicon, too, has a property of enhancing machinability, strength, wear resistance, resistance to stress corrosion cracking, and also high-temperature oxidation resistance. Aluminum works to raise the high-temperature oxidation resistance when it is used together with silicon in amounts not smaller than 0.1 percent by weight. But even if the addition of aluminum increases beyond 2.0 percent, by weight, no proportional results can be expected. For this reason, the addition of aluminum is set at 0.1 to 2.0 percent, by weight.

Phosphorus is added to enhance the flow of molten metal in casting. Phosphorus also works to improve the aforesaid machinability, de-zinc-ification corrosion resistance, and also high-temperature oxidation resistance, in addition to improving the flow of molten metal. These effects are exhibited when phosphorus is added in amounts not smaller than 0.01 percent, by weight. But even if phosphorus is used in amounts greater than 0.20 percent, by weight, it will not result in a proportional increase in effect; rather, it will cause weakening of the alloy. Based upon this consideration, phosphorus is added within a range of 0.01 to 0.2 percent by weight.

While silicon is added to improve machinability as mentioned above, it is also capable of improving the flow of molten metal like phosphorus does. The effect of silicon in improving the flow of molten metal is exhibited when it is added in an amount not smaller than 2.0. percent, by weight. The range of the addition for flow improvement overlaps that for improvement of the machinability. These taken into consideration, the addition of silicon is set to 2.0 to 4.5 percent, by weight.

Fourth Invention Alloy

Another embodiment of the present invention is a free-cutting copper alloy also with an excellent easy-to-cut feature which is composed of 71.5 to 78.5 percent, by weight, of copper; 2.0 to 4.5 percent, by weight, of silicon; 0.005 percent up to but less than 0.02 percent, by weight, of lead; one additional element selected from among 0.01 to 0.2 percent, by weight, of bismuth, 0.03 to 0.2 percent, by weight, of tellurium, and 0.03 to 0.2 percent, by weight, of selenium; and the remaining percent, by weight, of zinc, wherein the percent by weight of copper and silicon in the copper alloy satisfy the relationship $61-50Pb \leqq X-4Y \leqq 66+50Pb$, wherein Pb is the percent, by weight, of lead, wherein X is the percent, by weight, of copper, and Y is the percent, by weight, of silicon. This fourth copper alloy will be hereinafter called the "fourth invention alloy."

That is, the fourth invention alloy is composed of the first invention alloy and, in addition, one element selected from among 0.01 to 0.2 percent, by weight, of bismuth, 0.03 to 0.2 percent, by weight, of tellurium, and 0.03 to 0.2 percent, by weight, of selenium.

Bismuth, tellurium, and selenium, as with lead, do not form a solid solution with the matrix but disperse in granular form to enhance machinability. The addition of bismuth, tellurium and selenium can make up for the reduction of the lead content in the free-cutting copper alloy when it comes to enhancing machinability. The addition of any one of these elements, along with silicon and lead, could further improve the machinability beyond the level obtained from the addition of silicon and lead alone. From this finding, the fourth invention alloy was developed, in which one element selected from among bismuth, tellurium, and selenium is mixed. The addition of bismuth, tellurium, or selenium, as well as silicon and lead, can make the copper alloy so machinable that complicated forms can be freely cut out at a high speed. However, no improvement in machinability can be realized from the addition of bismuth, tellurium, or selenium in an amount of less than 0.01 percent by weight. In other words, at least 0.01 percent, by weight, of bismuth must be added, or at least 0.03 percent by weight of either tellurium or selenium must be added, before the addition of these elements will have a substantial effect on machinability. However, these three elements are expensive when compared with the cost of copper so it is important to mix elements wisely in order to form a commercially viable alloy. So, even if the addition of bismuth, tellurium or selenium exceeds 0.2 percent by weight, the proportional improvement in machinability is so small that addition beyond that level does not pay off economically. Furthermore, if the addition of these elements is more than 0.4 percent by weight, the alloy will deteriorate in hot workability characteristics, such as forgeability, and cold workability characteristics, such as ductility. While there might be a concern that heavy metals like bismuth would cause a problem similar to that of lead, a very small addition of less than 0.2 percent by weight is negligible and would present no particular health problems. From those considerations, the fourth invention alloy is prepared with the addition of bismuth kept to 0.01 to 0.2 percent, by weight, and the addition of tellurium or selenium kept to 0.03 to 0.2 percent, by weight. In this regard, it is desired to keep the combined content of lead and bismuth, tellurium, or selenium to not higher than 0.4 percent by weight. This limitation is because if the combined content of these four elements exceeds 0.4 percent by weight of the alloy, even if slightly, then there will begin a deterioration in hot workability and cold ductility characteristics of the alloy, and also there is fear that the form of chippings will change from those illustrated in FIG. 1B to those illustrated in FIG. 1A. But the addition of bismuth, tellurium or selenium, which improves the machinability of the copper alloy though a mechanism different from that of silicon, as mentioned above, would not affect the proper contents (i.e., percentages, by weight) of copper and silicon in the alloy. For this reason, the contents of copper and silicon in the fourth invention alloy are set at the same level as those in the first invention alloy.

In consideration of these observations, the fourth invention alloy is improved in machinability by adding to the Cu—Si—Pb—Zn alloy of the first invention alloy at least one additional element selected from among 0.01 to 0.2 percent, by weight, of bismuth, 0.03 to 0.2 percent, by weight, of tellurium, and 0.03 to 0.2 percent, by weight, of selenium.

Fifth Invention Alloy

A free-cutting copper alloy also with an excellent easy-to-cut feature which is composed of 71.5 to 78.5 percent, by weight, of copper; 2.0 to 4.5 percent, by weight, of silicon; 0.005 percent up to but less than 0.02 percent, by weight, of lead; at least one element selected from among 0.01 to 0.2 percent, by weight, of phosphorus, 0.02 to 0.2 percent, by weight, of antimony, 0.02 to 0.2 percent, by weight, of arsenic, 0.1 to 1.2 percent, by weight, of tin, and 0.1 to 2.0 percent, by weight, of aluminum; at least one element selected from among 0.01 to 0.2 percent, by weight, of bismuth, 0.03 to 0.2 percent, by weight, of tellurium, and 0.03 to 0.2 percent, by weight, of selenium; and the remaining percent, by weight, of zinc, wherein the percent by weight of copper, silicon, and the other selected element(s), (i.e., phosphorus, antimony, arsenic, tin and aluminum), in the copper alloy satisfy the relationship $61-50Pb \leqq X-4Y+aZ \leqq 66+50Pb$, wherein Pb is the percent, by weight, of lead, wherein X is the percent, by weight, of copper, Y is the percent, by weight, of silicon, Z is the percent, by weight, of the selected element from among phosphorous, antimony, arsenic, tin and aluminum, and a is a coefficient of the selected element, wherein a is −3 when the selected element is phosphorus, a is 0 when the selected element is antimony, a is 0 when the selected element is arsenic, a is −1 when the selected element is tin, and a is −2 when the selected element is aluminum. This free-cutting copper alloy is the fifth copper alloy mentioned above, and will be hereinafter called the "fifth invention alloy."

The fifth invention alloy has any one selected from among 0.01 to 0.2 percent, by weight, of bismuth, 0.03 to 0.2 percent, by weight, of tellurium, and 0.03 to 0.2 percent, by weight, of selenium in addition to the components in the second invention alloy. The grounds for mixing those additional elements and setting those amounts to be added are the same as given for the fourth invention alloy.

Sixth Invention Alloy

A free-cutting copper alloy also with excellent easy-to-cut feature coupled with a good high-temperature oxidation resistance which is composed of 71.5 to 78.5 percent, by weight, of copper; 2.0 to 4.5 percent, by weight, of silicon; 0.005 percent up to but less than 0.02 percent, by weight, of lead; at least one element selected from among 0.01 to 0.2 percent, by weight, of phosphorous, 0.02 to 0.2 percent, by weight, of antimony, 0.02 to 0.15 percent, by weight, of arsenic, 0.1 to 1.2 percent, by weight, of tin, and 0.1 to 0.2 percent, by weight, of aluminum; at least one element selected from among 0.01 to 0.2 percent, by weight, of bismuth, 0.03 to 0.2 percent, by weight, of tellurium, and 0.03 to 0.2 percent, by weight, of selenium; and at least one element selected from among 0.3 to 4 percent, by weight, of manganese, and 0.2 to 3.0 percent, by weight, of nickel so the total percent, by weight, of manganese and nickel is between 0.3 to 4.0 percent, by weight; and the remaining percent, by weight, of zinc, wherein the percent by weight of copper, silicon, and the selected element(s) from phosphorous, antimony, arsenic, tin, aluminum, manganese and nickel, in the copper alloy satisfy the relationship $61-50Pb \leqq X-4Y+aZ \leqq 66+50Pb$, wherein Pb is the percent, by weight, of lead, wherein X is the percent, by weight, of copper, wherein Y is the percent, by weight, of silicon, and Z is the amount in percent, by weight, of the at least one element selected from among phosphorous, antimony, arsenic, tin, aluminum, manganese and nickel, wherein a is a coefficient of the selected element, wherein a is −3 when the selected element is phosphorous, a is 0 when the selected element is antimony, a is 0 when the selected element is arsenic, a is −1 when the selected element is tin, a is −2 when the selected element is aluminum, a is 2.5 when the selected element is manganese and a is 2.5 when the selected element is nickel. The sixth copper alloy will be hereinafter called the "sixth invention alloy."

The sixth invention alloy contains one element selected from among 0.01 percent up to but less than 0.2 percent, by weight, of bismuth, 0.03 to 0.2 percent, by weight, of tellurium and 0.03 to 0.2 percent, by weight, of selenium in addition to the components of the third invention alloy. While a high-temperature oxidation resistance as good as in the third invention alloy is secured, the machinability is further improved by adding one element selected from among bismuth and other elements which are as effective as lead in raising the machinability.

Seventh Invention Alloy

A free-cutting copper alloy having the excellent easy to cut feature, and other desirable features of the first to sixth invention alloys is obtained by further limiting the composition of the first to sixth invention alloys so that the alloy contains no more than 0.5 percent, by weight, of iron. When manufacturing copper alloys, iron is an inevitable impurity. However, by restricting the range of this impurity to no more than 0.5 percent, by weight, further benefits are achieved. Specifically, iron degrades machinability of the first to sixth invention alloys, and also degrades buffing and plating characteristics. Thus, a seventh alloy, in accordance with the present invention, is any one of the first to sixth invention alloys having, in addition to the components of the these alloys, the further limitation that the alloy composition contains no more than 0.5 percent, by weight, of iron. The seventh invention alloy will be hereinafter called the "seventh invention alloy."

Eighth Invention Alloy

A free-cutting copper alloy, with further improved easy-to-cut properties, is obtained by subjecting any one of the preceding respective invention alloys to a heat treatment for 30 minutes to 5 hours at 400° C. to 600° C. The eighth copper alloy will be hereinafter called the "eighth invention alloy."

Ninth and Tenth Invention Alloys

A free-cutting copper alloy with further improved easy-to-cut properties is obtained by constructing any one of the preceding respective invention alloys to include (a) a matrix comprising an alpha phase, and (b) one or more phases selected from the group consisting of a gamma phase and a kappa phase. The ninth copper alloy will be hereinafter called the "ninth invention alloy."Furthermore, in accordance with a "tenth invention alloy," the ninth invention alloy can be further modified so that the one or more phases selected from the group consisting of the gamma and kappa phases are uniformly dispersed in the alpha matrix.

Eleventh Invention Alloy

A free-cutting copper alloy with further improved easy-to-cut properties is obtained by constructing any one of the preceding respective invention alloys subject to the further restriction that the metal construction of the alloy satisfies the following additional relationships: (i) $0\% \leqq \beta$ phase$\leqq 5\%$ of the total phase area of the alloy; (ii) $0\% \leqq \mu$ phase$\leqq 20\%$ of the total phase area of the alloy; and (iii) $18-500(Pb)\ \% \leqq \kappa$ phase$+\gamma$ phase$+0.3(\mu$ phase$)-\beta$ phase$\leqq 56+500(Pb)$ % of the total phase area of the alloy. The eleventh copper alloy will be hereinafter called the "eleventh invention alloy."

Twelfth and Thirteenth Invention Alloys

A free-cutting copper alloy actually demonstrating the improved easy-to-cut properties, in accordance with the present invention, is obtained by construction of any one of the preceding first to eleventh invention alloys, wherein a round test piece, formed from an extruded rod or as a casting of the alloy, when cut on a circumferential surface by a tungsten carbide tool, without a chip breaker, at a rake angle of −6 degrees and at a nose radius of 0.4 mm, at a cut rate of 60 to 200 m/min, a cutting depth of 1.0 mm, and a feed rate of 0.11 mm/rev, yields chips having one or more shapes selected from the group consisting of an arch shape, a needle shape and a plate shape. The twelfth copper alloy will be hereinafter called the "twelfth invention alloy." Likewise, another free-cutting copper alloy actually demonstrating improved easy-to-cut properties, in accordance with the present invention, is obtained by construction of any one of the preceding first to eleventh invention allows, wherein a round test piece, formed from an extruded rod or as a casting of the alloy, when drilled on a circumferential surface by a steel grade drill, having a drill diameter of 10 mm and drill length of 53 mm, at a helix angle of 32 degrees and a point angle of 118 degrees at a cutting rate of 80 m/min, a drilling depth of 40 mm, and a feed rate of 0.20 mm/rev, yields chips having one or more shapes selected from the group consisting of an arch shape and a needle shape. The thirteenth copper alloy will be hereinafter called the "thirteenth invention alloy."

The first to thirteenth invention alloys contain machinability improving elements, such as silicon, and have excellent machinability because of the addition of such elements. The effect of those machinability improving elements may be further enhanced by heat treatment. For example, those first to thirteenth invention alloys that are high in copper content with gamma phase in small quantities, and kappa phase in large quantities, may undergo a change in phase from the kappa phase to the gamma phase by heat treatment. As a result, the gamma phase is finely dispersed and precipitated, and the machinability is improved. In the manufacturing process of castings, expanded metals and hot forgings in practice, the materials are often force-air-cooled or water cooled depending on forging conditions, productivity after hot working (hot extrusion, hot forging, etc.), working environment, and other factors. In such cases of the first to thirteenth invention alloys, those alloys with a relatively low content of copper, in particular, are rather low in the content of the gamma phase and/or kappa phase and contain beta phase. By controlled heat treatment, the beta phase changes into gamma phase and/or kappa phase, and the gamma phase, and/or the kappa phase is finely dispersed and precipitated, whereby the machinability is improved.

However, a heat treatment temperature at less than 400° C. is not economical and practical in any case, because the aforesaid phase change will proceed slowly and much time will be needed. At temperatures over 600° C., on the other hand, the kappa phase will grow, or the beta phase will appear, in a manner that brings about no improvement in machinability. From a practical viewpoint, therefore, it is desired to perform the heat treatment for 30 minutes to 5 hours at 400° C. to 600° C. when heat treatment is used to alter machinability of the alloy by altering the phases of the metal construction.

DETAILED DESCRIPTION OF THE INVENTION

Figure 1A:
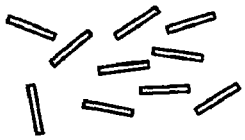
FIGS. 1A to 1G show perspective views of various types of cuttings formed in cutting a round bar of copper alloy by lathe.

The invention alloys each include copper, silicon, zinc and lead. Certain invention alloys additionally include other component elements, such as phosphorous, tin, antimony, arsenic, aluminum, bismuth, tellurium, selenium, manganese and nickel. Each of these elements bestow certain advantages to the invention alloys. For instance, copper is a major constituent element of the invention alloys. On the basis of studies performed by the present inventors, it was determined that a desirable copper content is between about 71.5 to 78.5 percent, by weight, in order to maintain certain inherent properties of a Cu—Zn alloy, such as certain mechanical properties, corrosion resistance property, and flowability. In addition, this copper range permits effective formation of gamma and/or kappa phases (and in some cases, a mu phase) in the metal construction when silicon is added, which results in industrially satisfactory machinability. However, the upper threshold limit for copper is set because when the copper content exceeds 78.5%, by weight, industrially satisfactory machinability is not achievable regardless of the degree of gamma and/or kappa phase formation. In addition, the castability of the alloy degrades when the copper content exceeds 78.5 percent, by weight. On the other hand, when the copper content falls below 71.5 percent, by weight, a beta phase tends to form easily in the metal construction. Beta phase formation tends to decrease machinability even with the presence of gamma and/or kappa phases in the metal construction. The formation of beta phase results in other adverse effects as well, such as decreased corrosion resistance against dezincification, increased stress corrosion cracking, and reduced elongation.

Silicon is another major constituent element for the invention alloys. In particular, silicon functions to improve machinability of copper alloys. Silicon is used to form gamma, kappa and/or mu phases in the matrix comprising an alpha phase, with the effect of improving machinability. The addition of less than 2 percent, by weight, of silicon in copper alloy does not result in sufficient formation of gamma, kappa and/or mu phases to achieve industrially satisfactorily machinability. While machinability will improve with an increase in the amount of silicon added to the alloy, when the amount of silicon added exceeds about 4.5 percent, by weight, machinability fails to improve proportionately. In fact, machinability begins to decrease in the alloy with silicon exceeding about 4.5 percent, by weight, because the proportion of gamma and/or kappa phases in the metal construction has grown too large. In addition, thermal conductivity of the alloy decreases with silicon exceeding about 4.5 percent, by weight. So, it is necessary to add silicon in a proper amount in order to improve machinability, as well as to improve other alloy characteristics such as flowability, strength, wear resistance, stress corrosion cracking resistance, high-temperature oxidation resistance, and dezincification resistance.

Zinc is also a major constituent element of the invention alloys. Zinc, when added to the copper and the silicon, effects formation of gamma, kappa, and, in some cases, mu phases. Zinc also works to improve mechanical strength, machinability and flowability of the invention alloys. In accordance with the present invention, the range of the zinc content is determined indirectly because zinc takes up the remaining portion of the invention alloys, apart from the other two major constituents (i.e., copper and silicon) and very low amounts of lead, and other component elements.

Lead is also present in the invention alloys because lead does not form a solid solution, but instead disperses as lead particles in the matrix of the metal construction, thereby improving machinability. Although a certain degree of machinability is achieved by the formation of gamma and/or kappa phases in the metal construction through the addition of silicon, more than 0.005%, by weight, of lead is also added in order to further improve machinability of the invention alloys. In fact, the machinability of the invention alloys is at least equivalent to, and often better than, the machinability of conventional free-cutting copper alloys at high speed cutting under a dry (i.e., without lubricant) condition, which is now strongly preferred by the industry. For Cu—Zn—Si alloys having a composition range falling within the scope of the present invention, the highest content of lead in the solid solution state is 0.003%, and any excess amount of lead is present in the structure of the alloy as lead particles. When the proper amount of gamma and/or kappa phases is present in the metal construction, lead begins to improve machinability of the alloy at about 0.005 percent, by weight, which is just slightly higher than the upper limit of the lead content in solid solution. Consequently, there is no appreciable amount of lead available for leaching out of the alloy and into drinking water, for example. In addition, as the amount of lead is increased to more than 0.005 percent, by weight, the machinability of the copper alloy significantly improves due to an unexpected synergistic effect of (a) the lead particles precipitated and finely dispersed in the matrix and (b) the hard gamma and kappa phases that function to improve machinability by a different mechanism. However, when the lead content of a metal alloy exceeds 0.02%, the lead contained in casting products, especially in large casting products, begins to leach out of the metal alloy and into the environment (i.e., into drinking water) thereby resulting in possible lead toxicity to humans. For these reasons, the lead content of the present invention alloys is set at 0.005 to 0.02, percent, by weight.

Phosphorous works to uniformly disperse and distribute gamma and/or kappa phases formed in the alpha matrix of a metal construction. Therefore, the addition of phosphorous in certain embodiments, in accordance with the present invention, further enhances and stabilizes the machinability of the invention copper alloys. Additionally, phosphorous improves corrosion resistance, especially dezincification corrosion resistance, and flowability. To achieve these advantages, more than 0.01%, by weight, of phosphorous should be added to the invention alloy. However, when the addition of phosphorous exceeds 0.2%, by weight, further positive effects are not obtained but the ductility also degrades. In view of these effects of added phosphorous, the addition of phosphorous, in accordance with the present invention, is preferably at 0.02 to 0.12%, by weight.

As previously mentioned, tin expedites the formation of gamma phase and, at the same time, works to disperse, and to distribute more evenly, gamma and/or kappa phases formed in the alpha matrix, so tin further improves machinability of Cu—Zn—Si metal alloys. Tin also improves corrosion resistance, especially against erosion corrosion and dezincification corrosion. To achieve such positive effects against corrosion, more than 0.1%, by weight, of tin should be added. On the other hand, when the addition of tin exceeds 1.2%, by weight, the excess tin reduces ductility and the impact value of the invention alloy because of the formation of excessive gamma phase and the emergence of beta phase so cracks occur easily when cast. Thus, in order to secure the positive effects of added tin, while avoiding the degradation of ductility and impact value, the addition of tin, in accordance with the present invention, is preferably at 0.2 to 0.8%, by weight.

Antimony and arsenic are elements added to improve dezincification corrosion resistance of metal alloys in accordance with the present invention. For this purpose, more than 0.02%, by weight, of antimony and/or arsenic should be added to the invention alloy. When the addition of these elements exceeds 0.2%, by weight, further positive effects are not obtained and ductility is degraded. In view of these effects of adding these elements, the addition of antimony and/or arsenic, in accordance with the present invention, is preferably at 0.03 to 0.1%, by weight.

Aluminum expedites the formation of gamma phase and, at the same time, works to disperse, and to distribute more evenly, gamma and/or kappa phases formed in the alpha matrix. Thus, aluminum further improves machinabilityof Cu—Zn—Si system alloys. Additionally, aluminum improves mechanical strength, wear resistance, high-temperature oxidation resistance and erosion-corrosion resistance. In order to obtain these positive effects, more that 0.1%, by weight, of aluminum should be added to the invention alloy. However, when the addition of aluminum exceeds 2%, the excess aluminum reduces ductility and casting cracks tend to form easily because of the formation of excessive gamma phase and the emergence of beta phase. Therefore, the addition of aluminum, in accordance with the present invention, is preferably at 0.1 to 2.0%, by weight.

Similar to lead, added bismuth, tellurium and selenium disperse in the alpha matrix and significantly improve machinability by a synergistic effect with hard phases, such as gamma, kappa and mu phases. Such synergistic effects are obtained when the addition of bismuth, tellurium and selenium is more than 0.01%, more than 0.03%, and more than 0.03%, by weight, respectively. However, these elements have not been confirmed to be safe to the environment, nor are they abundantly available. Therefore, in accordance with the present invention, the upper limit for each of these elements is set at 0.2%, by weight. More preferably, in accordance with the present invention, the ranges of bismuth, tellurium, and selenium are set at 0.01 to 0.05%, at 0.03 to 0.10%, and at 0.03 to 0.1%, by weight, respectively.

Manganese and nickel improve wear resistance and strength of the Cu—Si—Zn alloys of the present invention by combining with silicon to form intermetallic compounds. For these improvements to occur, the required addition for manganese is more than 0.3%, by weight, and for nickel, more than 0.2% by weight. When the addition of manganese and nickel exceed 4% and 3%, by weight, respectively, further improvement in wear resistance is not obtained but ductility and flowability degrades. Therefore, the sum amount of added manganese and nickel, in accordance with the present invention, should be over 0.3%, by weight, yet should not exceed 4%, by weight, since wear resistance is not further improved by higher amounts of these elements and machinability and flowability are negatively effected at higher levels. Necessarily, when manganese and/or nickel is added to the invention alloy, silicon consumption is accelerated because these elements combine with silicon to form intermetallic compounds, thereby leaving less silicon available to form gamma and/or kappa phases and improving machinability. Thus, in accordance with the present invention, in order to achieve industrially satisfactory machinability of a Cu—Si—Zn alloy containing manganese and/or nickel as well, the following relationship should be satisfied:

$$2+0.6(U+V) \leqq Y \leqq 4+0.6(U+V),$$

where Y is the percent, by weight, of silicon; U is the percent, by weight, of manganese; and V is the percent, by weight, of nickel. In this way, silicon is present in the alloy in sufficient amounts to both form intermetallic compounds and to form gamma, kappa and/or mu phases.

Iron combines with silicon contained in Cu—Si—Zn alloys of the present invention to form intermetallic compounds. Such iron-containing intermetallic compounds, however, degrade the machinability of the invention alloy and negatively effect buffing and plating processes performed during production of faucets and water valves, which are conventionally produced by casting and not machining. When the iron content of an alloy exceeds 0.5%, by weight, the above mentioned negative effects are clearly observed, although they are also still recognizable at an iron content of 0.3%, by weight. While iron is an inevitable impurity in Cu—Si—Zn alloys, in accordance with the present invention the iron content does not exceed 0.5%, by weight, and preferably does not exceed 0.25%, by weight.

Table 1 shows several alloys manufactured in accordance with the first invention alloy, as well as alloys made in accordance with the fourth and seventh to eleventh invention alloys. Table 1 also includes several comparison alloys that do not fall within the scope of the present invention. Table 2 shows several alloys manufactured in accordance with the second and third invention alloys, as well as alloys made in accordance with the fifth to eleventh invention alloys. Table 2 also includes several comparison alloys that do not fall within the scope of the present invention. The results compiled in Tables 1 and 2 will be explained following the present description of the various tests employed for comparing characteristics of alloys of the present invention with similar alloys that do not fall within the scope of the present invention.

Exemplary Samples

As examples of alloys of the present invention and of comparison alloys, cylindrical ingots with the compositions as shown in Tables 1 and 2, each 100 mm in outside diameter and 150 mm in length, were hot extruded into a round bar 20 mm in outside diameter at mostly 750° C. to produce the test pieces, although some samples were hot extruded at 650° C., or at 800° C. For each extruded alloy ingot, the elemental and phase compositions are described, together with the elemental and phase compositions expressed in terms of formulae employed in the present invention. Also, results of tests as described below are provided. As can be seen from the data in the Tables, for alloys of a given elemental composition, the extrusion temperature has a significant effect on the phase composition and material properties as will be explained below. In addition, molten metal having the same elemental compositions as the cylindrical ingots was poured into a permanent mold of 30 mm in diameter and 200 mm in depth to form cast test pieces. Such cast test pieces were then cut by a lathe into a round bar of 20 mm in outside diameter so that the cast pieces are the same size as the extruded pieces. Alloys cast, instead of hot extruded, as compiled in Tables 1 and 2 show how manufacturing conditions effect the metal construction and other characteristics of the alloy as will be explained below.

Cutting Tests

To study the machinability of the various alloys, lathe cutting tests and drilling cutting tests were carried out to determine whether an alloy has industrially satisfactory machinability. In order to make this determination, alloy machinability has to be evaluated under cutting conditions that are generally applied in the industry. For example, the cutting speed for copper alloys in industry is normally 60 to 200 m/min when lathe cutting or drill cutting is employed. Therefore, for the examples provided in the Tables, lathe cutting tests were conducted at the speeds of 60, 120 and 200 m/min. Drill cutting tests were conducted at a speed of 80 m/min. In the tests employed, evaluations were made on the basis of cutting force and condition of chippings. Because cutting lubricant has a possible negative impact on the environment, it is desirable to conduct cutting without lubricant so waste cutting lubricant does not have to be discarded. Therefore, the cutting tests, in accordance with the present invention, were conducted under the dry condition (i.e., without lubricant) even though this is not a favorable cutting condition in terms of facilitating the process of cutting.

The lathe cutting tests were conducted in the following manner: The extruded test pieces, or the cast pieces, thus obtained as described above so as to be 20 mm in diameter were cut, under the dry condition, on the circumferential surface by a lathe provided with a point nose straight tool, in particular a tungsten carbide tool without chip breaker, at a rake angle of −6 degrees with a nose radius of 0.4 mm, at a cutting rate of 60, 120 and 200 meters/minute (m/min), a cutting depth of 1.0 mm, and a feed rate of 0.11 mm/rev. Signals from a three-component dynamometer mounted on the tool were converted into electric voltage signals and recorded on a recorder. The signals were then converted into the cutting resistance. Thus, machinablility of the alloys was evaluated by determining the cutting resistance, especially the principal cutting force that shows the highest value when cutting. In addition, the metal alloy chips yielded during lathe cutting were examined and classified as part of the machinability evaluation of the lathed material. It is noted that while, to be perfectly exact, the amount of the cutting resistance should be judged by three component forces, i.e., cutting force, feed force, and thrust force, it was decided to evaluate cutting resistance on the basis of the cutting force (N) only. The results of the lathe cutting tests are compiled in Tables 1 and 2. It can be seen from the data in Tables 1 and 2 that alloys of the present invention do not require excessive cutting force.

The drill cutting tests were conducted in the following manner: The extruded test pieces, or the cast pieces, thus obtained as described above so as to be 20 mm in diameter were cut, under the dry condition, using a steel grade M7 drill having a drill diameter of 10 mm and a drill length of 95 mm, at a helix angle of 32 degrees with a point angle of 118 degrees, at the cutting rate of 80 m/min, a drilling depth of 40 mm, and a feed rate of 0.20 mm/rev. The metal alloy chips yielded during drill cutting were examined and classified as part of the machinability evaluation of the drilled material.

Figure 1B:
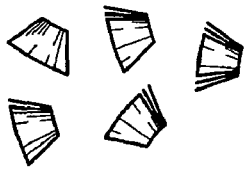
Figure 1C:
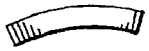
Figure 1D:
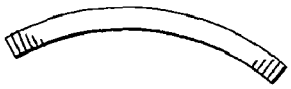
Figure 1E:
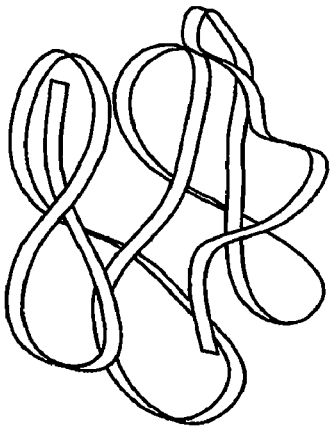
Figure 1F:
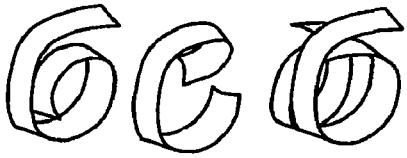
Figure 1G:
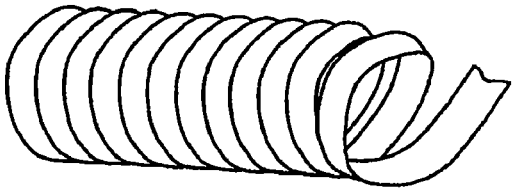

The chips yielded during cutting were examined and classified into seven categories (A) to (G), based on the geometrical form of the chips as shown in FIGS. 1A to 1G and as described as follows. FIG. 1A illustrates "needle chips," which are finely segmentalized, needle-like chips, and which are represented by • in the Tables. Needle chips are industrially satisfactory chip products produced when cutting metal alloys having industrially satisfactory machinability. FIG. 1B illustrates "arch chips," which are arch-shaped or circular arch-shaped chips with less than one winding, and which are represented by ◎ in the Tables. Arch chips are industrially satisfactory chip products produced by cutting materials having most desirable machinability characteristics. FIG. 1C illustrates "short rectangular chips," which are rectangular chips that are less than 25 mm in length, and which are represented by ○ in the Tables. Short rectangular chips are industrially satisfactory chip products produced when cutting metal alloys having industrially satisfactory machinability that is better than alloys producing needle chips but not as good as alloys producing arch chips during cutting. Short rectangular chips are also referred to as "plate-shaped." FIG. 1D illustrates "medium length rectangular chips," which are rectangular chips that are 25 mm to 75 mm in length, and which are represented by ▲ in the Tables. FIG. 1E illustrates "long chips," which are rectangular chips that are more than 75 mm in length, and which are represented by X in the Tables. FIG. 1F illustrates "short spiral-shaped chips," which are spiral-shaped chips with one to three windings, and which are represented by Δ in the Tables. Short spiral-shaped chips are also industrially satisfactory chip products produced when cutting metal alloys having industrially satisfactory machinablility. Lastly, FIG. 1G illustrates "long spiral-shaped chips," which are spiral-shaped chips with more than three windings, and which are represented by XX in the Tables. The results of chips yielded during the cutting tests are reported in Tables 1 and 2.

Chip production during cutting provides indicia regarding the quality of the alloy material. Metal alloys producing long chips (X), or long spiral-shaped chips (XX), do not yield industrially satisfactory chips. On the other hand, metal alloys producing arch-shaped chips (◎) yield the most desirable chips, metal alloys producing short rectangular chips (○) yield the second most desirable chips, and metal alloys producing needle chips (•) yield the third most desirable chips. Metal alloys producing short spiral-shaped chips (Δ) also yield industrially desirable chips. In this regard, the chippings in the form of a spiral with three or more windings as shown in FIG. 1G are difficult to process, (i.e., recover or recycle), and could cause trouble in cutting work as, for example, by getting tangled with the cutting tool and damaging the cut metal surface. Chippings in the form of a spiral arc from one with a half winding to one with two or three windings as shown in FIG. 1F do not cause such serous trouble as chippings in the form of a spiral with more than three windings, yet the short spiral-shaped chips are not easy to remove and could get tangled with the cutting tool or damage the cut metal surface.

In contrast, chippings in the form of a fine needle chips shown in FIG. 1A, or in the form of arch chips shown in FIG. 1B, do not present such problems as mentioned above, are not as bulky as the chippings shown in FIGS. 1F and 1G, and are easy to process for recovery or recycling. However, fine needle chips as shown in FIG. 1A still could creep in on the slide table of a machine tool such as a lathe and cause mechanical trouble, or could be hazardous because they could stick into a worker's finger, eye, or other body part. When these factors are taken into account, when evaluating machinability and the overall industrial production, the invention alloys yielding the chippings shown in FIG. 1B are the best at meeting industrial requirements, while metal alloys yielding chippings shown in FIG. 1C are the second best, and metal alloys yielding chippings shown in FIG. 1A are the third best at meeting industrial requirements. As mentioned above, metal alloys that yield those chippings shown in FIGS. 1E and 1G are not good from an industrial standpoint because the chippings are difficult to recover or recycle, and these kinds of chippings may damage the cutting tool or the workpiece being cut. In Tables 1 and 2, the chippings shown in FIGS. 1A, 1B, 1C, 1D, 1E, 1F and 1G are produced by various alloys and are indicated by the symbols "•", "◎", "○", "▲", "X", "Δ", and "XX" respectively. It can be seen that alloys of the present invention generally produce the best forms of chippings.

To summarize the qualitative classification of chippings (in descending order) with respect to desired industrial machinability, the arch-shaped chips (◎), the short rectangular chips (○) and the fine needle chips (•) are rated as having excellent machinability (i.e., arch-shaped chips) to good machinability (i.e., short rectangular chips) to satisfactory machinability (i.e., fine needle chips). While industrially acceptable, the medium rectangular chips (▲) and the short-spiral chips (Δ) may get tangled with tools during cutting. Therefore, these chips are not as desirable as chippings having been produced by alloys rated as having satisfactory to excellent machinability.

In today's industry, manufacturing involves automation (i.e., especially during overnight operations) so a single worker commonly monitors the operation of several cutting machines at the same time. During cutting, once the volume of chips produced becomes too large to be handled by the single worker, problems with the cutting operation may occur, such as tangling of chips with the cutting tool or even shut-down of the cutting machine. As a practical matter, chippings such as the long rectangular chips (X), and the long spiral chips (XX), are large chips having a significantly greater volume than the arch-shaped chips, the short rectangular chips, and the fine needle chips. Consequently, during cutting, the volume of long rectangular chips and long spiral chips accumulates at rates a hundred times that of the smaller chips (i.e., arch-shaped chips, short rectangular chips, and fine needle chips). Therefore, overnight machining operations are less practical, or require more personnel to monitor the cutting machines, when alloys are machined that generate voluminous long rectangular chips or long spiral chips. In comparison, medium length rectangular chips (▲) and the short-spiral chips (Δ) are much less voluminous than long rectangular chips or long spiral chips, and only a few times more voluminous than arch-shaped chips, short rectangular chips, and fine needle chips.

As it turns out, alloys producing the medium length rectangular chips and the short-spiral chips during cutting are still "industrially acceptable" because the volume of chips produced do not accumulate at an unacceptably fast rate as occurs for long rectangular chips or long spiral chips. On the other hand, because the medium length rectangular chips and the short-spiral chips may tangle the cutting tool, alloys producing these chips must be carefully monitored during cutting. Thus, the machinability of such alloys is less desirable than alloys producing arch-shaped chips, short rectangular chips, or fine needle chips, which are compact low-volume chips and tend not to tangle the cutting tool. With respect to medium length rectangular chips and short-spiral chips, alloys producing medium length rectangular chips during cutting are considered to have slightly better machinability than those producing short-spiral chips because, while both chip types may tangle the cutting tool, medium length rectangular chips are easier to remove once they get tangled with the cutting tool. In addition, medium length rectangular chips have less volume than short-spiral chips, so they will pile up during cutting at a slower rate than for the short spiral-shaped chips.

Tests for Dezincification Corrosion

Furthermore, the various alloys were put to de-zinc-ification corrosion tests in accordance with the test method specified under "ISO 6509" to examine their corrosion resistance. In the de-zinc-ing corrosion test by the "ISO 6509" method, a test piece taken from each extruded test piece tested was laid and imbedded in a phenolic resin material in such a way that the exposed test piece surface is perpendicular to the extrusion direction of the extruded test piece. The surface of the test piece was polished with emery paper No. 1200, and then ultrasonic-washed in pure water and dried. The test piece thus prepared was dipped in a 12.7 g/L aqueous solution of cupric chloride dihydrate ($CuCl_2.2\ H_2O$) 1.0% and left standing for 24 hours at 75° C. Each test piece was then taken out of the aqueous copper solution and the maximum depth of de-zincing corrosion was determined as follows. The test piece was again laid and imbedded in phenolic resin material in such a way that the exposed test piece surface was kept perpendicular to the extrusion direction. Then, the test piece was cut so that the longest cut section can be obtained. The test piece was subsequently polished and corrosion depth was observed, for 10 microscope fields, using a 100× to 500× metallurgical microscope. The deepest point of corrosion was recorded as the measured maximum de-zinc-ification corrosion depth. Measurements of the maximum de-zinc-ification corrosion depth are given in Tables 1 and 2.

As is clear from the results of de-zinc-ification corrosion tests shown in Tables 1 and 2, the first to third invention alloys are excellent in corrosion resistance. And it was confirmed that especially the fourth to eleventh invention alloys are very high in corrosion resistance, as seen in Tables 1 and 2.

Tests for Erosion Corrosion

Test pieces cut out of the extruded test material were also used to evaluate erosion corrosion resistance of the invention alloys. The weight of each test piece was measured using an electronic scale before exposure to a brine solution for 96 hours. A 3% brine solution at 30° C. with 0.01% cupric chloride dihydrate ($CuCl_2.2\ H_2O$) was continuously blasted, using a 2 mm-caliber spray nozzle, against the test pieces at a flow rate of 11 m/s for 96 hours. After 96 hours of exposure to the brine solution, the mass loss was evaluated as follows. Each test piece was blow-dried and re-weighed on the electronic scale. The difference in the weight of the test piece before brine exposure and after brine exposure was recorded as the measured mass loss, which reflects the degree off erosion corrosion of the alloy by the brine solution.

It is important for certain products to be made using metal alloys that have good resistance to erosion corrosion. For example, water supply faucets and valves need to be resistant against erosion corrosion, as well as resistant to general corrosion, because these devices are subjected to crosscurrent, or sudden changes of water speed, caused by opening and closing of the fluid flow flowing through these devices. Comparative Alloy No. 28 (C83600) shown in Table 2, for example, contains 5%, by weight, of tin and 5%, by weight, of lead, and demonstrates excellent erosion-corrosion resistance even in a rapid current. As shown in Table 2, Comparative Alloy No. 28 (hereafter, CA No. 28) has among the lowest weight loss due to erosion corrosion. The erosion-corrosion resistance of CA No. 28 is due to the formation of a tin-rich film that protects the alloy from corrosion under rapid currents. Unfortunately, CA No. 28 has an unacceptably high lead content and is not suitable for use in systems providing potable drinking water.

In comparison, the first invention alloy also has good erosion corrosion resistance, as demonstrated by First Invention Alloy No. 2 of Table 1. However, the addition of 0.3%, by weight, of tin as shown by Second Invention Alloy No. 11 improves erosion corrosion resistance. In fact, while the formation of the same tin-rich tin-silicon based film applies here, the addition of 0.3%, by weight, of tin to First Invention Alloys provides Second Invention Alloys having improved erosion corrosion resistance, but at a fraction of the amount of tin employed in CA No. 28. In other words, alloys of the present invention and containing, for example, only about 0.3%, by weight, of tin, achieve the same degree of erosion corrosion resistance as CA No. 28, which includes a much higher percentage (i.e., 5%, by weight) of tin.

Performance Tests for Lead Leachability

Tests to evaluate the leachability of lead were conducted pursuant to "JIS S 3200-7:2004" in accordance with the "water supply equipment—performance tests for leachability" method. In accordance with JIS S 3200-7:2004, the leaching solution employed for the test was prepared by adding (a) 1 ml of a sodium hypochlorite solution with an available chlorine concentration of 0.3 mg/ml, (b) 22.5 ml of 0.04 mol/L sodium hydrogen carbonate solution, and (c) 11.3 ml of 0.04 mol/L calcium chloride solution into water so that the total amount of the test solution will be one liter. This solution was then adjusted, by adding 1.0% and 0.1% of hydrochloric acid and 0.1 mol/L of sodium hydroxide, so the solution used for the test would meet the following parameters: pH 7.0±0.1, hardness 45 mg/L±5 mg/L, alkalinity 35 mg/L±5 mg/L, and residual chlorine 0.3 mg/L±0.1 mg/L. The sample ingot obtained by casting was drilled to make a hole so that the cup-shaped test pieces 25 mm in inside diameter and 180 mm in depth can be obtained. Such cup-shaped test pieces were rinsed and conditioned, and then filed with the leaching solution at a temperature of 23° C. The test pieces were then sealed and stored in a place maintained at the temperature of 23° C. The leaching solution was collected after storage for 16 hours and tested to analyze the lead leachate. No correction was made to the results of the analysis of the lead leachate for the volume, surface area or the shape of the test pieces.

Alloy Composition Constraing Formula

Another feature of the copper alloys of the present invention is that each copper alloy composition is constrained by the general formula relationship $$61-50\text{Pb} \leqq X-4Y+a_oZ_o \leqq 66+50\text{Pb}, \quad (1)$$

wherein Pb is the percent, by weight, of lead, where X is the percent, by weight, of copper; Y is the percent, by weight, of silicon; and $a_OZ_o$ represents the contribution to the relationship of elements other than copper, silicon and zinc. In other words, the relationship described by the alloy composition constraint formula (1) is required to make copper alloy compositions with the advantages described above. If formula (1) is not satisfied, then by experiment, it has been found that the resulting copper alloy does not provide the degree of machinability and other properties shown in Tables 1 and 2. However, the mere limitation of the content range for copper, zinc and silicon provided by formula (1) does not, by itself, determine the amount of kappa, gamma and mu phases formed in the structure of the metal alloy. As discussed above, the phase construction and the amount of kappa, gamma and mu phases work to improve machinability. Furthermore, the elemental relationship provided by formula (1) cannot, by itself, determine the amount of beta phase formed, which acts to degrade machinability. Thus, formula (1) provides an index, obtained by experiment, to determine alloy compositions that may achieve the appropriate amount of each component phase (i.e., optimizing combinations of gamma, kappa and mu phases for improving machinability while minimizing formation of beta phase that degrades machinability).

We describe the contribution to the relationship of constraint formula (1) by elements other than copper, silicon and zinc in formula (2) as follows:

$$a_oZ_o=a_1Z_1+a_2Z_2+a_3Z_3+\ldots \quad (2)$$

where $a_1$, $a_2$, $a_3$, etc., are experimentally determined coefficients, and $Z_1$, $Z_2$, $Z_3$, etc., are percents, by weight, of elements in the composition other than copper, silicon and zinc. In other words with respect to formula (1), Z is the amount of a selected element and a is the coefficient of the selected element.

Specifically, it has been determined that in order to practice the copper alloys of the present invention, the "a" coefficients are as follows: for lead, bismuth, tellurium, selenium, antimony, and arsenic, the a coefficient is zero; for aluminum, the a coefficient is −2; for phosphorus, the a coefficient is −3; and for manganese and nickel, the a coefficient is +2.5. It will be appreciated by one skilled in the art, that formula (1) does not directly constrain the amounts of lead, bismuth, tellurium, selenium, antimony and arsenic in the copper alloys of the present invention because the a coefficient is zero for these elements; however, these elements are indirectly constrained by the fact that the percent, by weight, of copper, silicon, and those elements in the copper alloy, and having non-zero a coefficients, must satisfy constraint formula (1).

In addition, lead, even in a slight amount, has an important role in the invention alloys as a component for improving machinability. Therefore, the effect of lead has been taken into account when deriving formula (1). In the case where the value of X−4Y+aZ becomes less than 61−50PB, the phase composition necessary to achieve industrially satisfactory machinability cannot be obtained on the whole, even with the effects of lead. On the other hand, when the value of X−4Y+aZ becomes greater than 66+50Pb, despite the positive effect by lead on machinability, the excessive amount of gamma, kappa and/or mu phases formed makes such an alloy unable to obtain industrially satisfactory machinability. It is also more preferable when the relationship 62−50Pb≦X−4Y+aZ≦65+50Pb is satisfied.

To be even more specific, for the first and fourth invention alloys, constraint formula (1) can be written as:

$$61-50\text{Pb} \leqq X-4Y \leqq 66+50\text{Pb}, \quad (3)$$

wherein Pb is the percent, by weight, of lead, where X is the percent, by weight, of copper and Y is the percent, by weight, of silicon in the alloy. Free-cutting copper alloys of the first and fourth invention alloys have high strength as well as industrially satisfactory machinability. Therefore, these alloys are of great practical value and can be used to make machined, forged and cast products presently made out of conventional free-cutting copper alloys. For example, the first and fourth invention alloys are suitable for manufacturing bolts, nuts, threads, spindles, stems, valve seat rings, valves, water supply/drainage metal fittings, gears, general machine parts, flanges, parts for measuring instruments, parts for building, and clamps.

For the second and fifth invention alloys, constraint formula (1) can be written as:

$$61-50\text{Pb} \leqq X-4Y+aZ \leqq 66+50\text{Pb}, \quad (4)$$

wherein Pb is the percent, by weight, of lead, where X is the percent, by weight, of copper; Y is the percent, by weight, of silicon; Z is the percent, by weight of one or more elements selected from phosphorous, antimony, arsenic, tin and aluminum; wherein a is −3 for phosphorous, a is 0 for antimony and arsenic, a is −1 for tin, and a is −2 for aluminum. Free-cutting copper alloys of the second and fifth invention alloys have high corrosion resistance as well as industrially satisfactory machinability. Therefore, these alloys are of great practical value and can be used to make machined, forged and cast products that have to be resistant to corrosion. For example, the second and fifth invention alloys are suitable for manufacturing water faucets, hot water supply pipe fittings, shafts, connecting fittings, parts for heat exchanger, sprinklers, turncocks, valve seats, water meters, parts for sensors, pressure vessels, valves for industrial use, box nuts, pipe fittings, marine structural metal applications, joints, water stop valves, valves, tube connectors, cable connectors, and fittings.

For the third and sixth invention alloys, constraint formula (1) can be written as:

$$61-50\text{Pb} \leqq X-4Y+aZ \leqq 66+50\text{Pb}, \quad (5)$$

wherein Pb is the percent, by weight, of lead, where X is the percent, by weight, of copper; Y is the percent, by weight, of silicon; $Z_1$ is the percent, by weight of at least one element selected from among phosphorus, antimony, arsenic, tin and aluminum in the alloy, wherein $a_1$ is −3 for phosphorous, $a_1$ is 0 for antimony and arsenic, $a_1$ is −1 for tin, and $a_1$ is −2 for aluminum; and $Z_2$ is the percent, by weight, of at least one element selected from among manganese and nickel, wherein $a_2$ is 2.5 for manganese and for nickel. Free-cutting copper alloys of the third and sixth invention alloys have high wear resistance and high strength as well as industrially satisfactory machinability. Therefore, these alloys are of great practical value and can be used to make machined, forged and cast products that require high wear resistance and high strength. For example, the third and sixth invention alloys are suitable for manufacturing bearings, bushes, gears, parts for sewing machines, hydraulic system parts, nozzles for kerosene oil and gas heaters, limbs, sleeves, fishing reels, fittings for aircraft, slide members, cylinder parts, valve seats, synchronizer rings, and high pressure valves.

For those invention alloys wherein manganese and/or nickel combine with silicon to form intermetallic compounds, the alloy composition is further constrained by the relationship shown in Formula (6), which is:

$$2+0.6(U+V) \leqq Y \leqq 4+0.6(U+V), \quad (6)$$

wherein Y is the percent, by weight of silicon, U is the percent, by weight of manganese, and V is the percent, by weight, of nickel.

To summarize, all of the first through the thirteenth invention alloys of the present invention must satisfy the alloy composition constraint of Formula 1, and all of the illustrative examples provided in accordance with the present invention in Tables 1 and 2 comply with this composition constraint. On the other hand, the third and sixth invention alloys are further constrained by the secondary alloy composition constraint of Formula 8. Other copper alloys that contain the same elements as the copper alloys of the present invention, but which do not have a composition satisfying the requirements of Formula 1, and when appropriate Formula 8 as well, will not have the characteristics of the copper alloys of the present invention as shown in Tables 1 and 2 as explained below.

Figure 3A:
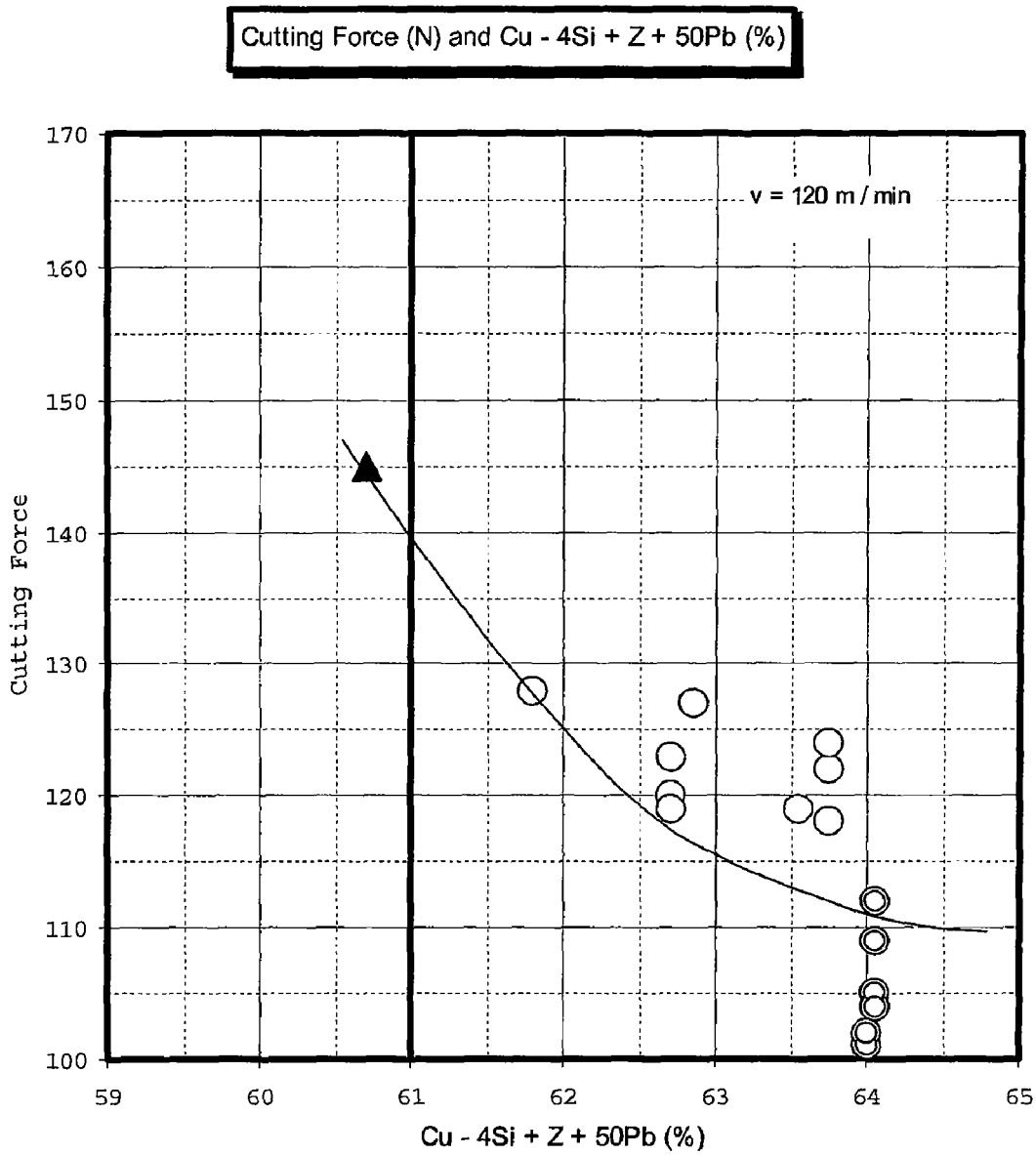
FIGS. 3A and 3B show the relationship between the cutting force and the formula Cu−4Si+X+50Pb (%) for an alloy of the present invention, wherein the cutting speed v=120 m/min.
Figure 3B:
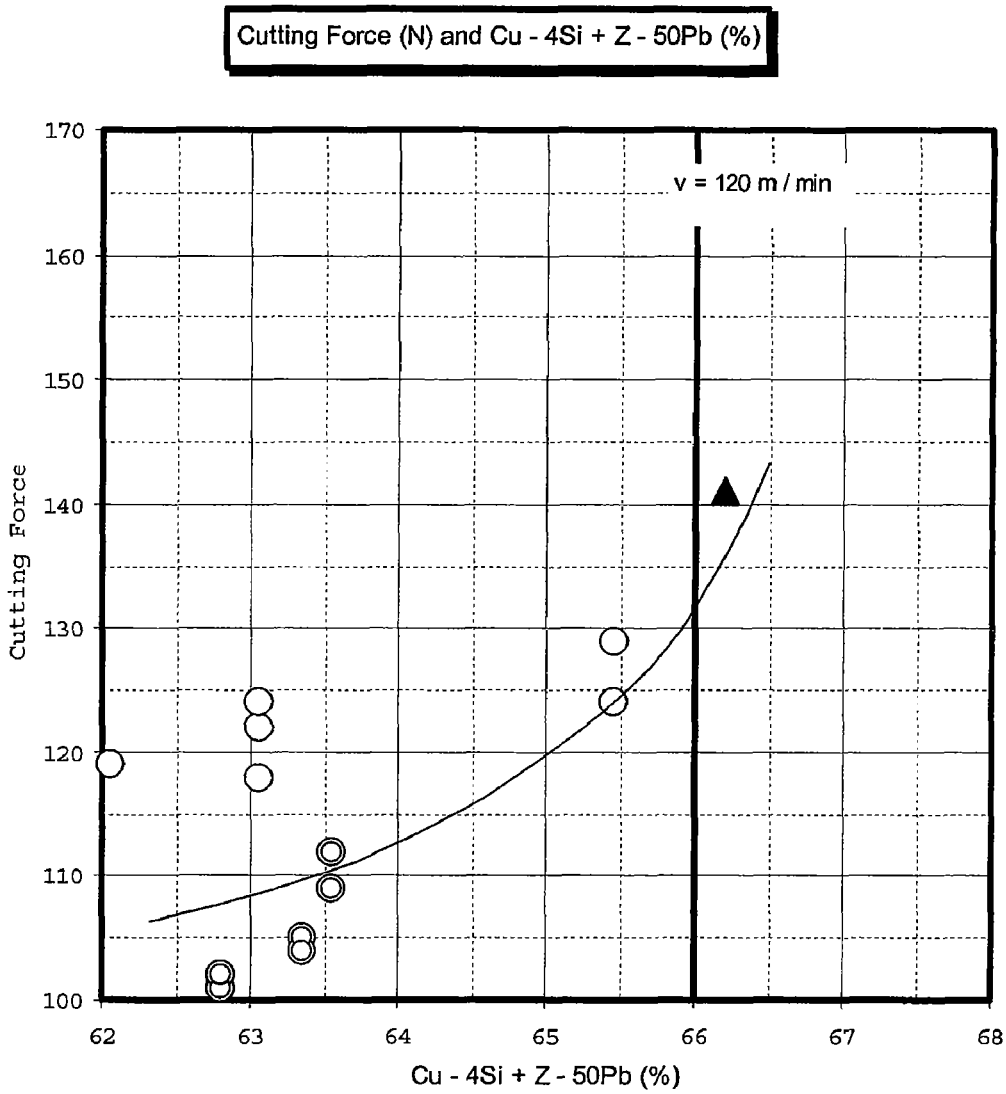
Figure 4A:
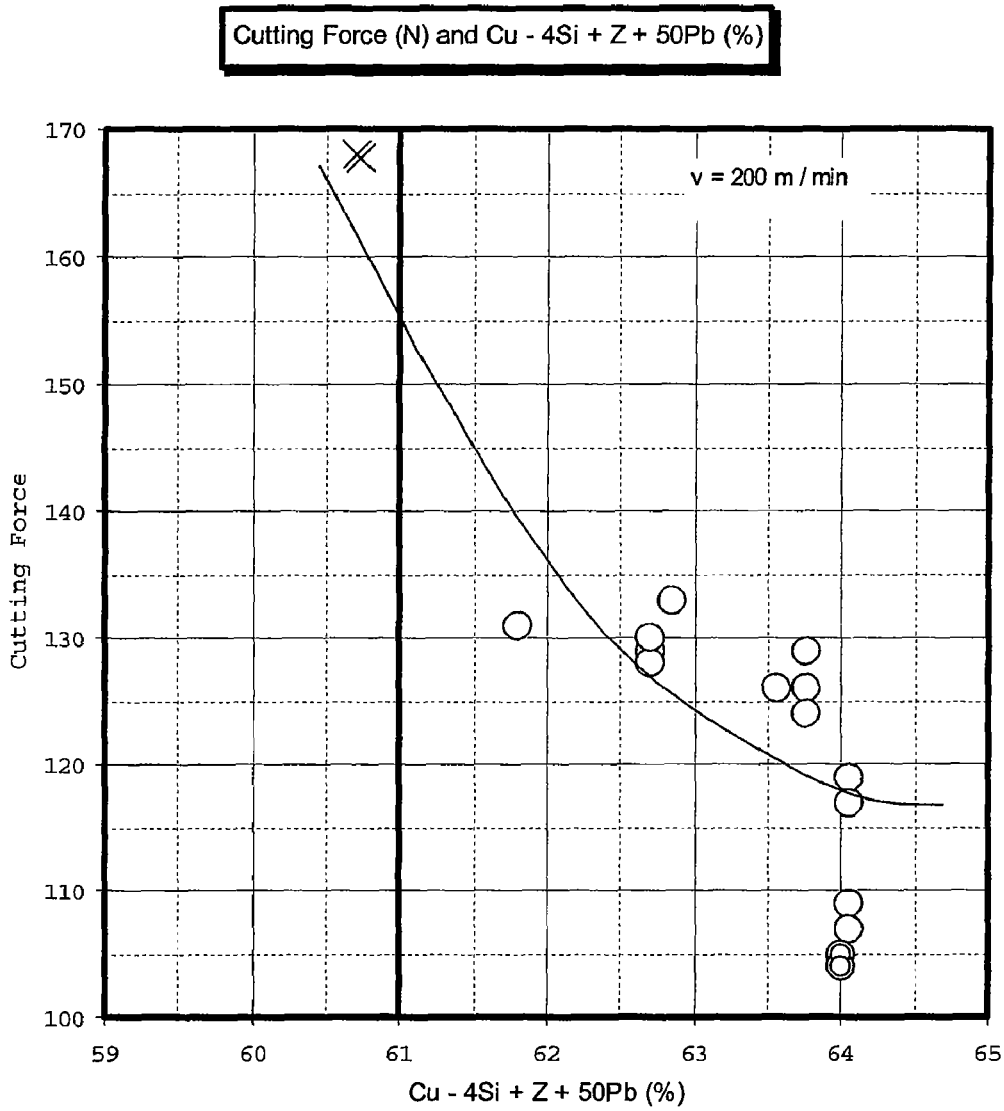
FIGS. 4A and 4B show the relationship between the cutting force and the formula Cu−4Si+X+50Pb (%) for an alloy of the present invention, wherein the cutting speed v=200 m/min.
Figure 4B:
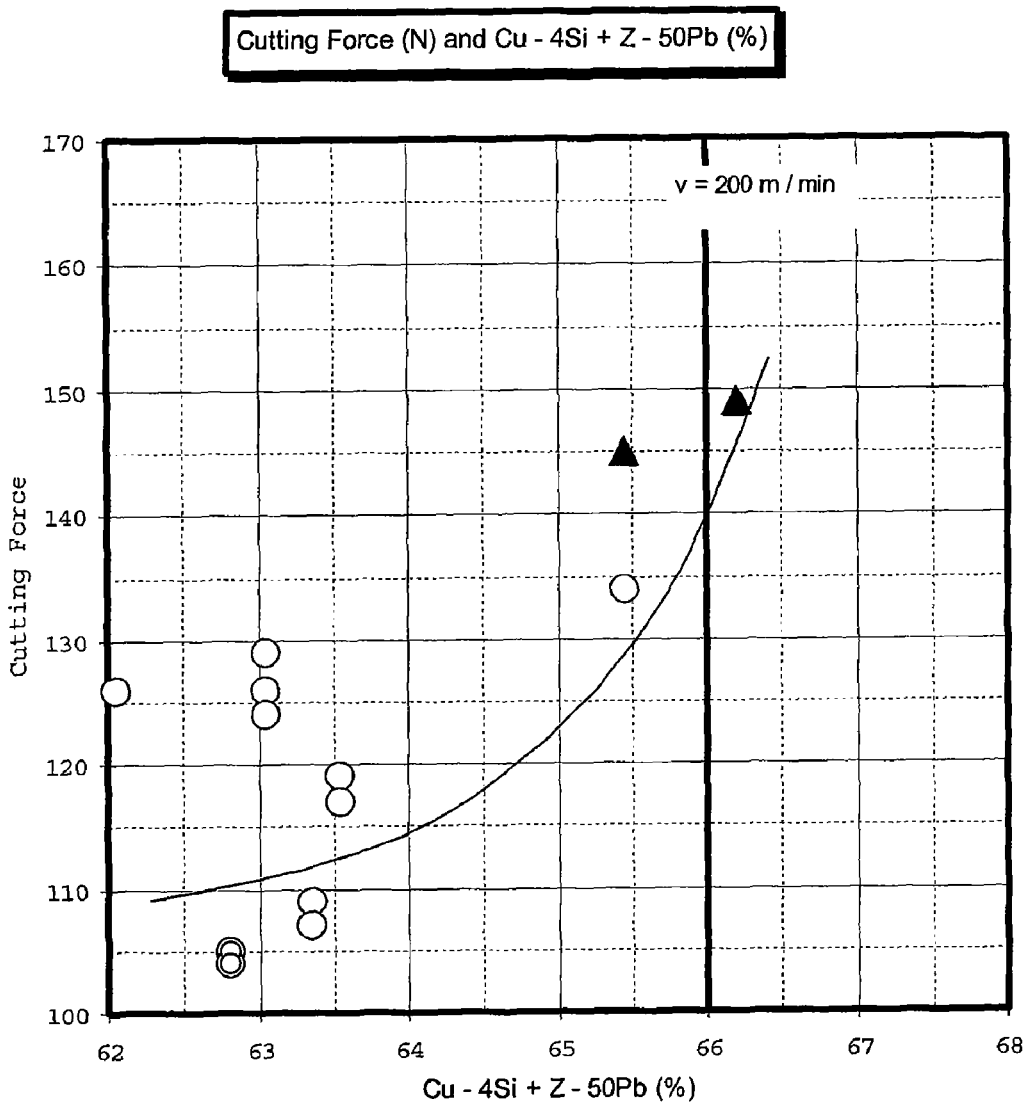

FIGS. 3A, 3B, 4A and 4B illustrate the general effect of the composition constraint Formula 5 on the machinability of a Cu—Si—Zn alloy. FIGS. 3A and 3B demonstrate how the cutting force needed to machine the alloy rises as the constraint formula X−4Y+aZ+50Pb (%) approaches either the lower limit of 61, or the constraint formula of X−4Y+aZ−50Pb (%) approaches the higher limit of 66, respectively. At the same time, as the lower and upper limits of the constraint formula are exceeded, the chippings yielded change in character from desirable arch chips and short rectangular chips (i.e., ◎ and ○, respectively) to undesirable medium length rectangular chips (i.e., ▲) at a cutting speed of 120 m/min. Likewise, FIGS. 4A and 4B demonstrate how the cutting force needed to machine the alloy rises as the constraint formula X−4Y+aZ+50Pb (%) approaches either the lower limit of 61, or the constraint formula of X−4Y+aZ−50Pb (%) approaches the higher limit of 66, respectively. However, this rise in cutting force is more dramatic at the higher cutting speed of 200 m/min. At the same time, as the lower and upper limits of the constraint formula are exceeded, the chippings yielded change in character from desirable arch chips and short rectangular chips (i.e., ◎ And ○, respectively) to undesirable medium length rectangular chips and long chips (i.e., ▲ and X, respectively) at a cutting speed of 200 m/min. So increased cutting speed also affects the character of the chippings yielded during cutting.

Metal Construction

Figure 2:
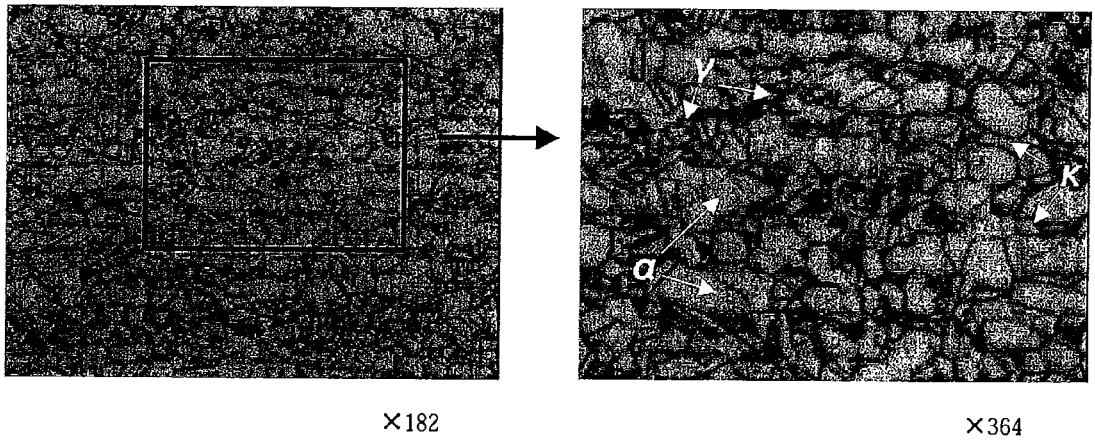
FIG. 2 is a magnified view, taken by photograph, of the metal construction of a first invention alloy of the present invention.

Another important feature of the copper alloys of the present invention is the metal construction, being the matrix of the metal, formed by the integration of multiple phase states of the component metals, which produces a composite phase for the copper alloy. Specifically, as one skilled in the art will appreciate, a given metal alloy may have different characteristics depending upon the environment in which it was produced. For example, applying heat to temper steel is well known. The fact that a given metal alloy may behave differently depending upon the conditions in which it was forged is due to the integration and conversion of components of the metal to different phase states. As is illustrated in Tables 1 and 2, the copper alloys of the present invention all include an a phase, which is about 30 percent or more of the total phase area to practice the invention. This is because the a phase is the only phase that gives metal alloys a degree of cold workability. To illustrate the phase relationships of the metal construction, in accordance with the present invention, micrographs magnified at ×186 and at ×364 are shown in FIG. 2. The metal alloy photographed in this instance is the first invention alloy, No. 2, of Table 1. As can be seen by the micrographs, the metal construction includes an α phase matrix in which one or more of a γ phase and/or a κ phase are dispersed. Although not shown in these micrographs, the metal construction may include other phases as well, such as the μ phase. As would be understood by a person of ordinary skill in the art, if the copper alloy has less than about 30% α phase comprising the total phase area of the metal, then the copper alloy is not cold workable and can not be further processed by cutting in any practical manner. Therefore, all of the copper alloys of the present invention have a metal construction that is a composite phase that is an a phase matrix to which other phases are provided.

As mentioned above, the presence of silicon in the copper alloys of the present invention is to improve the machinability of the copper alloy, and this occurs partly because silicon induces a y phase. Silicon concentrations in any one of the γ, κ, and μ phases of a copper alloy are 1.5 to 3.5 times as high as that in the α phase. Silicon concentrations in the various phases, from high to low, are as follows: μ≧γ≧κ≧β≧α. The γ, κ, and μ phases also share the characteristic that they are harder and more brittle than the α phase, and impart an appropriate hardness to the alloy so that the alloy is machinable and so that the cuttings formed by machining are less likely to damage the cutting tools as describe regarding FIG. 1. Therefore, to practice the invention, each copper alloy must have at least one of the γ phase, the κ phase, and the μ phase, or any combination of these phases, in the α phase in order to provide a suitable degree of hardness to the copper alloy.

The β phase generally improves machinability of prior art Cu—Zn alloys and is included in alloys, C36000 and C37700, of the prior art at 5-20%. In comparing C2700 (65% Cu and 35% Zn) containing no β phase and C28000 (60% Cu and 40% Zn) containing 10% β phase, C28000 has better machinability than C2700 (refer to "Metals Handbook Volume 2, 10th Edition, ASM P217, 218). On the other hand, experiments on the present invention alloys show that β phase does not contribute to the machinability, but actually reduces machinability in an otherwise unexpected manner. As it turns out, the β phase offsets the effectiveness of the κ and γ phases on improving machinability on about a 1:1 basis. Therefore, for the alloys of the present invention, β phase in the metal construction is undesirable because it degrades machinablility. Moreover, β phase is further undesirable because it decreases corrosion resistance of the alloys.

Thus, another goal of the copper alloys of the present invention is to limit the amount of β phase in the a matrix of the metal construction. It is desired to limit the β phase to 5% or less of the total phase area because the β phase does not contribute to either the machinability or the cold workability of the copper alloy. Preferably, the β phase is zero in the metal construction of the present invention, but it is acceptable to have the β phase contribute up to 5% of the total phase area.

In improving machinability, the effect of the μ phase is minor and is as small as 30% of that of the κ, and γ phases. Therefore, it is desirable to limit the μ phase to no more than 20%, or preferably no more than 10%.

Figure 7:
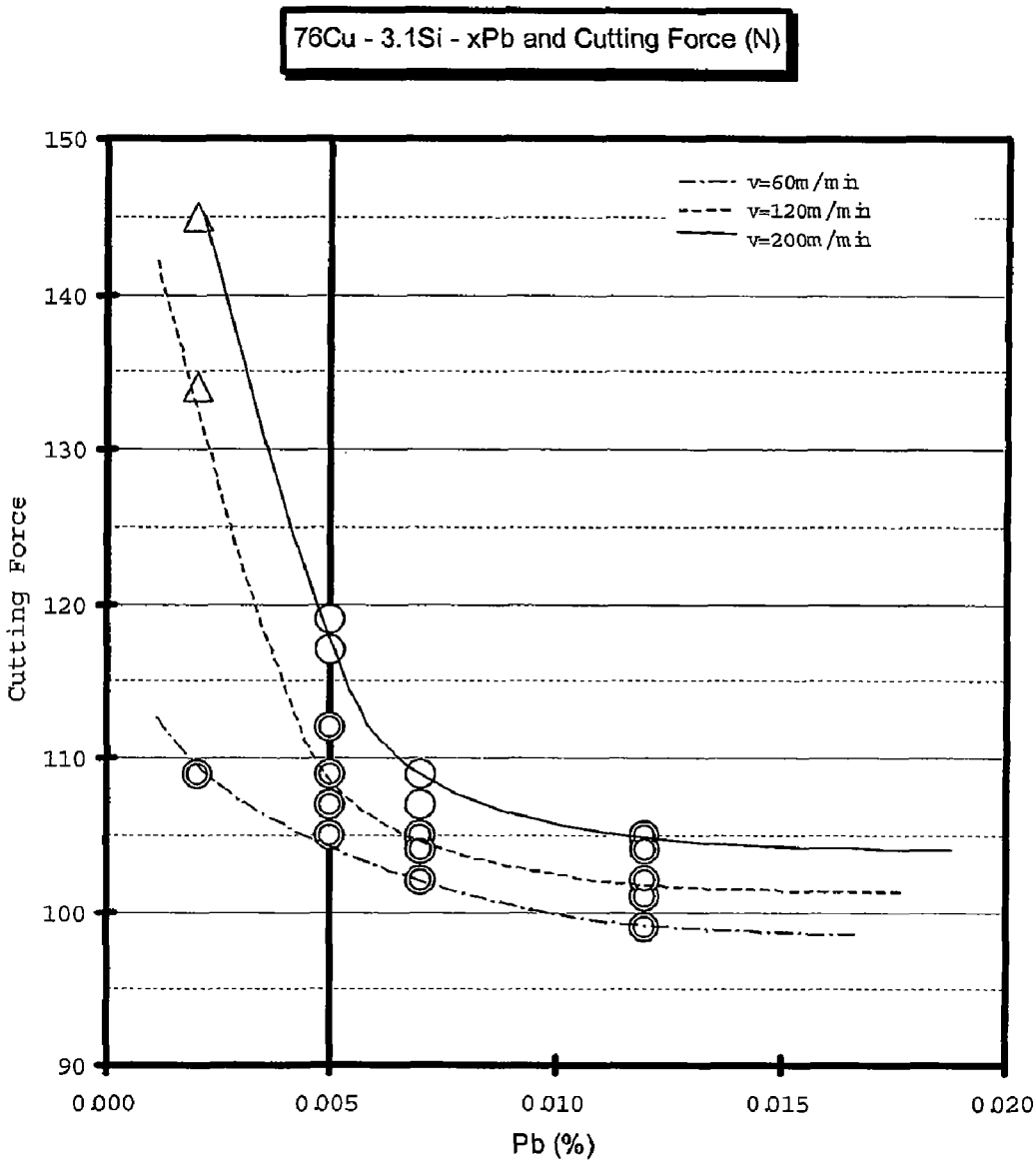
FIG. 7 shows the relationship between cutting force and the amount of lead, by percent weight, in an alloy of the formula 76(Cu)-3.1 (Si)—Pb (%).

Machinability also improves with increasing Pb as shown in FIG. 7, which illustrates the yield of arch chippings (◎), short rectangular chippings (○) and short spiral-shaped chippings (Δ). The present invention exhibits rapid improvement in machinability as the Pb content increases due to synergistic effects of the soft and finely-dispersed Pb particles together with the hard phases such as κ, γ, and μ. When the above phase limits are met, Pb content can be as low as 0.005% for industrially satisfactory machinability as shown in FIG. 7. However, the effects shown in FIG. 7 occur due to a synergistic effect with the metal construction, which, for the alloy 76(Cu)-3.1(Si)—Pb (%), provides industrially satisfactory machinability when constrained in accordance with the relationship shown in Formula 7 described below. FIG. 7 demonstrates that when the amount of lead, by weight, drops below 0.005%, the amount of cutting force required generally increases significantly, especially for the higher cutting speeds of v=120 m/min and v=200 m/min. Furthermore, the character of the cuttings is likely to change as well.

Those copper alloys in accordance with the eleventh invention alloy of the present invention, as illustrated in Tables 1 and 2, are additionally constrained to a metal construction as follows: (1) an α phase matrix of about 30% or more; (2) a β phase of 5% or less; (3) a μ phase of 20% or less, and consequently (4) the relationship shown in formula (7) as well:

$$18-500Pb \leqq \kappa+\gamma+0.3\mu-62 \leqq 56+500Pb, \quad (0.005\% \leqq Pb \leqq 0.02\%. \tag{7}$$

In Formula 7, Pb is the percent, by weight of lead, and κ, γ, β and μ each represent the percent of gamma, kappa, beta and mu phases, respectively, of the total phase area of the metal construction. Formula 7 applies only when 0.005%≦Pb≦0.02%, by weight. Under this constraint, in accordance with this present invention alloy, gamma and kappa phases have the most important role in contributing to improved machinability. However, the mere presence of gamma and/or kappa phases is not enough to obtain industrially satisfactory machinability. In order to achieve such machinability, it is necessary to determine the total proportion of gamma and kappa phases in the structure. In addition, the impact of other phases in the metal construction, such as mu and beta phases, must be taken into consideration as well. Empirically, the present inventors have found that mu phase is also effective at improving machinability, but its effect is relatively minor compared to the effects of the kappa and gamma phases. More specifically, the contribution to improved machinability by the mu phase is only about 30% the contribution to improved machinability provided by gamma and kappa phases. With respect to the presence of beta phase on machinability, the present inventors have found that, empirically, the negative effect of beta phase offsets the positive effects of gamma and/or kappa phases on a 1:1 basis. In other words, the combined amount of gamma and kappa phases required to obtain a certain level of improved machinability is the same as the amount of beta phase that is required to negate this improvement.

However, the extremely slight addition of lead, which has the function of improving machinability by a different mechanism than the gamma and kappa phases, to the present invention alloys should be considered for its contribution to machinability. When lead is factored in to effects on machinability, the range of acceptable phase combinations calculated by κ+γ+0.3μ−β can be widened. Empirically, the present inventors have found that the addition of 0.01 percent, by weight, of lead to the alloy has the equivalent effect improving machinability as 5% gamma or kappa phase, but only when lead is in the range of 0.005%≦Pb≦0.02%, by weight. Therefore, the range of acceptable phase combinations obtained by calculating κ+γ+0.3μ−β should be expanded on the basis of such a proportion. Accordingly, the amount of each phase, namely gamma and kappa phase for improving, mu phase for improving but less effectively as gamma and kappa, and beta phase for degrading, machinability can be modified within the bounds of the constraint formula (7) by adding or deleting phases. In other words, formula (7) should be considered an important index to determine machinability. When the value of κ+γ+0.3μ−β is less than 18−500Pb, then industrially satisfactory machinability cannot be obtained. It is also more preferable when the relationship 22−500Pb≦κ+γ+0.3μ−β≦50+500Pb is satisfied.

Figure 5A:
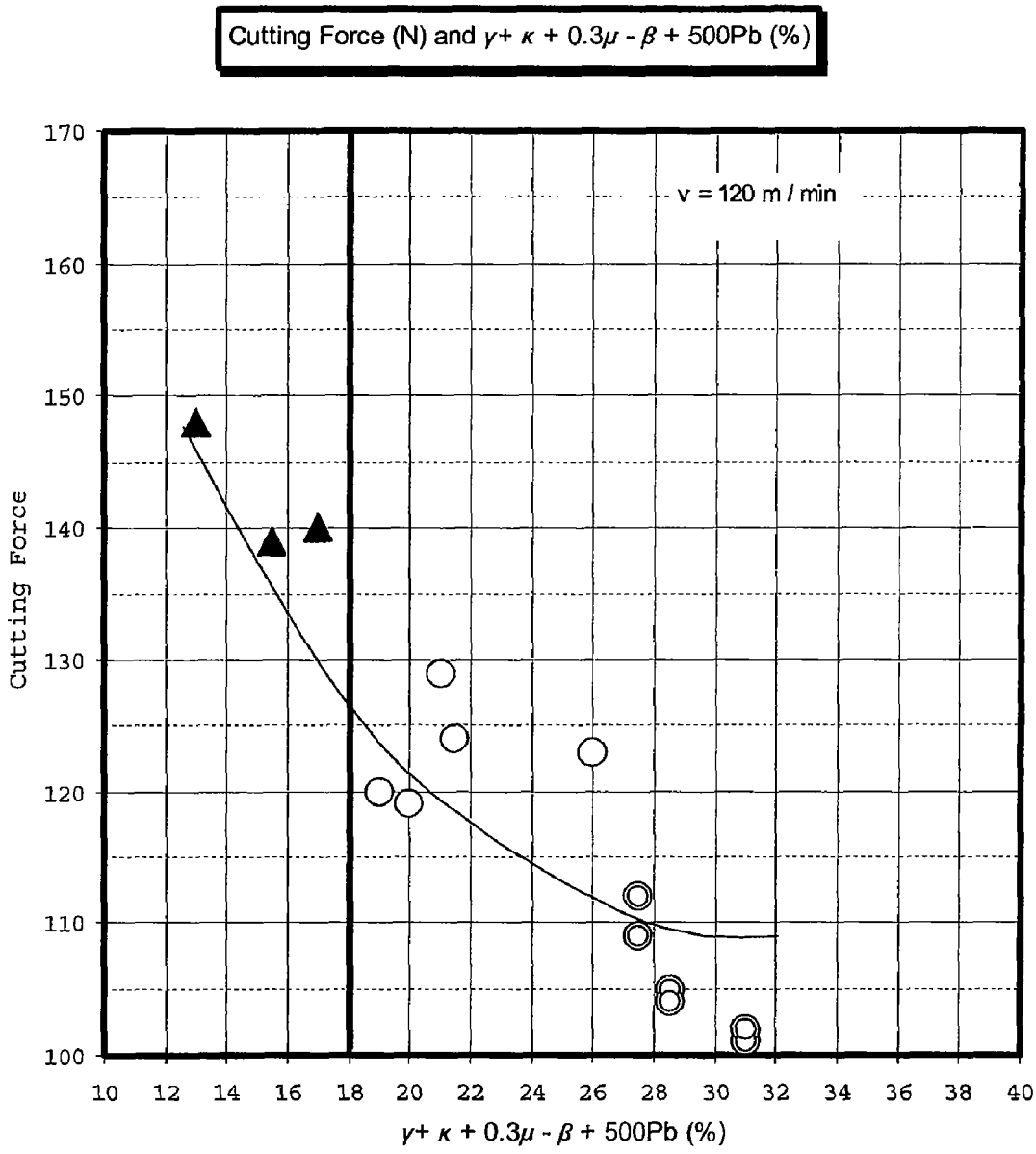
FIGS. 5A and 5B show the relationship between the cutting force and the formula $\kappa+\gamma+0.3\mu-\beta+500Pb$ for an alloy of the present invention, wherein the cutting speed v=120 m/min.
Figure 5B:
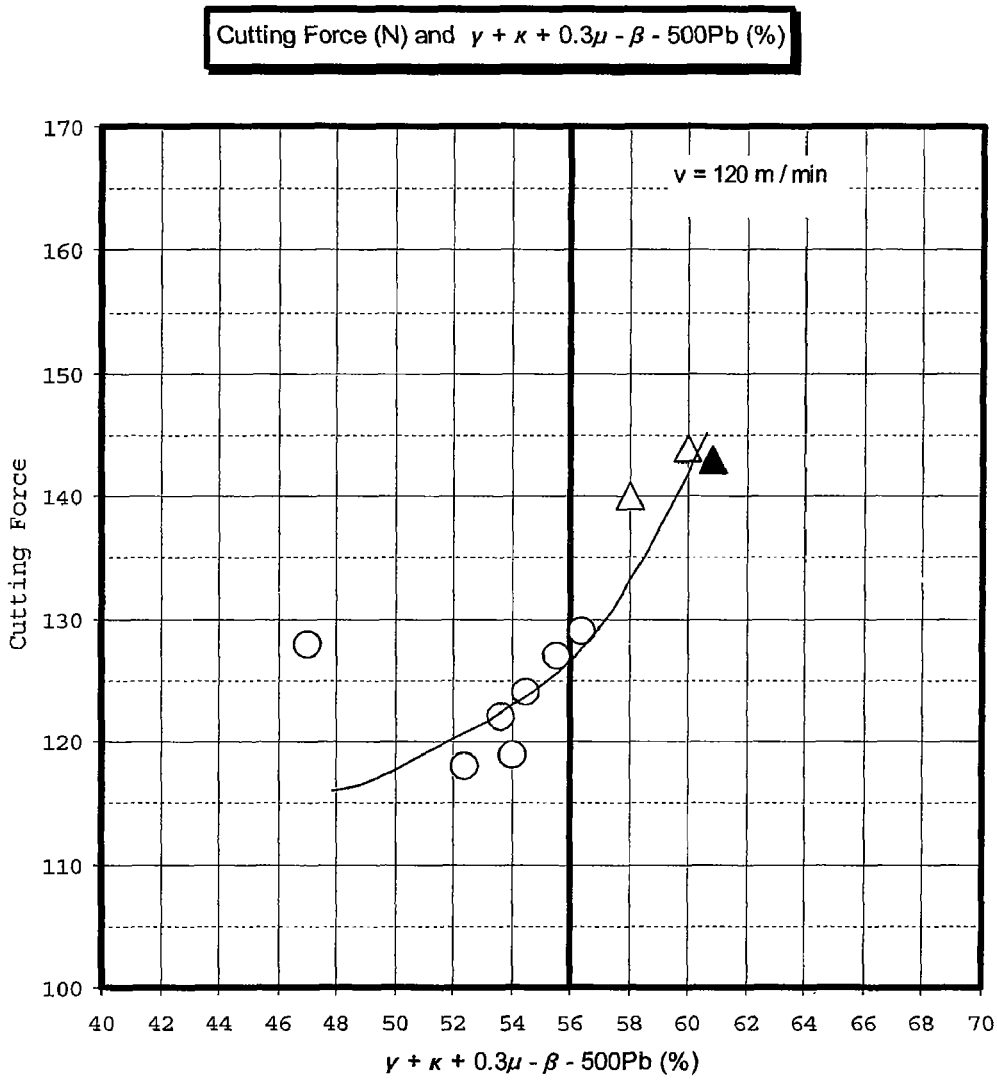
Figure 6A:
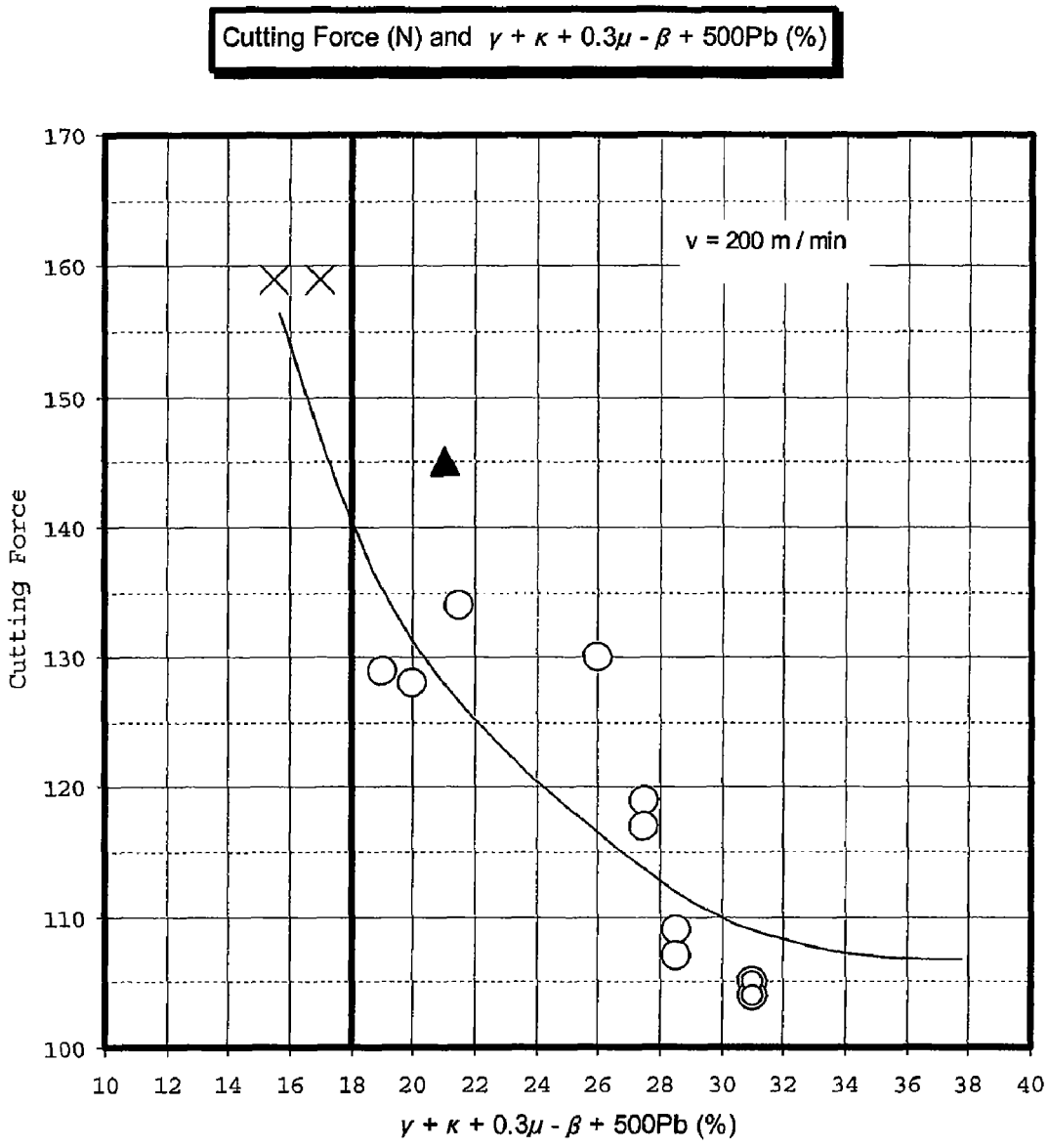
FIGS. 6A and 6B show the relationship between the cutting force and the formula $\kappa+\gamma+0.3\mu\beta+500Pb$ for an alloy of the present invention, wherein the cutting speed v=200 m/min.
Figure 6B:
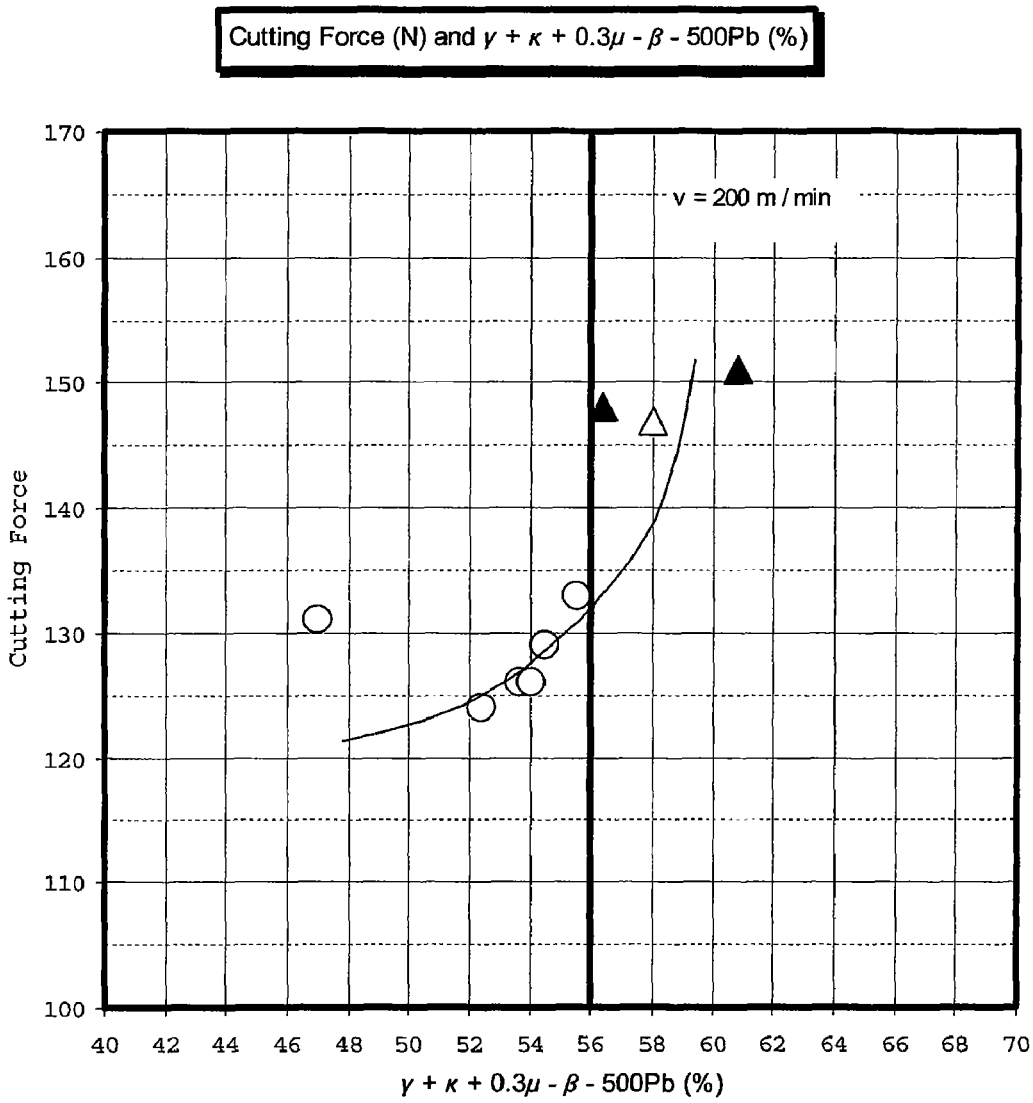

FIGS. 5A, 5B, 6A and 6B illustrate the general effect of the phase constraint Formula 7 on the machinability of a Cu—Si—Zn alloy. FIGS. 5A and 5B demonstrate how the cutting force needed to machine the alloy rises as the constraint formula κ+γ+0.3μ−β+500Pb (%) approaches either the lower limit of 18, or the constraint formula of κ+γ+0.3μ−β−500Pb (%) approaches the higher limit of 56, respectively. At the same time, as the lower and upper limits of the constraint formula are exceeded, the chippings yielded change in character from desirable arch chips, short rectangular chips, and short spiral-shaped chips (i.e., ◎, ○ and Δ, respectively) to undesirable medium length rectangular chips (i.e., ▲) at a cutting speed of 120 m/min. Likewise, FIGS. 6A and 6B demonstrate how the cutting force needed to machine the alloy rises as the constraint formula κ+γ+0.3μ−β+500Pb (%) approaches either the lower limit of 18, or the constraint formula of κ+γ+0.3μ−β−500Pb (%) approaches the higher limit of 56, respectively. However, this rise in cutting force is more dramatic at the higher cutting speed of 200 m/min. At the same time, as the lower and upper limits of the constraint formula are exceeded, the chippings yielded change in character from predominately desirable arch chips and short rectangular chips (i.e., ◎And ○, respectively) to predominately undesirable medium length rectangular chips and long chips (i.e., ▲ and X, respectively) at a cutting speed of 200 m/min. So increased cutting speed also affects the character of the chippings yielded during cutting.

It is pointed out that although other metal constructions are possible where the γ, κ, and μ phases total more than 70% of the total phase area, the result is a copper alloy that has no problem with machinability, but as a result has an α phase matrix of less than 30% which results in such a poor degree of cold workability as to render the alloy of reduced practical value. The percent of lead and β phase may be included along with the γ, κ, and μ phases in this maximum value of 70%. Alternately, one may ensure that the ox phase is at least 30% of the total phase area. On the other hand, if the copper has less than 5% of the total phase area comprised of the γ, κ, and μ phases then the machinability of the copper alloy is rendered unsatisfactory. The β phase is minimized to less than 5% of the total phase area because the β phase does not contribute to either the machinability or cold workability of the copper alloy. In addition, because the a phase is the soft phase for the metal construction, and therefore has ductility, the machinability of the copper alloy is greatly improved by adding even an extremely small amount of lead. The result is that the metal construction of the present invention utilizes the α phase as the matrix in which the γ, κ, and μ phases disperse.

Heat Treatment

Persons skilled in the art will realize that metal structure cannot be determined solely by the composition of the constituent elements of the alloy. Instead, metal structure also depends on the various conditions, such as temperature and pressure, used to form the alloy. For example, the alloy metal structure obtained by quenching after casting, extrusion and blazing is greatly different from the alloy metal structure obtained by slow cooling, and in most cases, would contain a large amount of beta phase. Therefore, in accordance with the eighth invention alloys of the present invention, heat treatment should be conducted for 20 minutes to 6 hours at 460° C. to 600° C. in order to convert beta phase into gamma and/or kappa phases or to improve dispersion of the gamma and/or kappa phases in cases where alloy manufacturing requires quenching and where the alloy produced has gamma and/or kappa phases that are not desirably dispersed in the metal structure. By employing the aforementioned heat treatment, alloys with better industrially satisfactory machinability can be obtained by reducing the amount of beta phase and dispersing the gamma and/or kappa phases.

Comparison of the Invention Alloys With Non-Invention Alloys

The results compiled in Table 1 will be described first. All of the alloys compiled in Table 1 fall within the scope of the first invention alloy except for the comparison alloys Nos. 1, 4, 5, 6, 9, 13, 14, 18, 19, 20, 21, 22 and 23. Alloys Nos. 1A, 1 B, 2, 3, 11, 24, 25 and 26 all fall within the scope of the first invention alloys and within one or more of the further limited fourth through eleventh invention alloys. The remaining alloys compiled in Table 1 are provided to demonstrate various results when the phase relationships of formula (7) are not met or if some other limitation of the fourth through eleventh invention alloys is not met. For the purposes of interpreting machinability results, in accordance with the present invention, excellent machinability is achieved when chips yielded in all four cutting tests (i.e., lathe cutting at 60,120 and 200 m/min and drill cutting at 80 m/min) are either needle shaped as in FIG. 1A, or arch shaped as in FIG. 1B, or short rectangular shape (i.e., length <25 mm) as shown in FIG. 1C. However, industrially satisfactory machinability is achieved when chips yielded in all four cutting tests (i.e., lathe cutting at 60,120 and 200 m/min and drill cutting at 80 m/min) are either needle shaped as in FIG. 1A, or arch shaped as in FIG. 1B, or short rectangular shape (i.e., length <25 mm) as shown in FIG. 1C, or short spirals with 1 to 3 windings as shown in FIG. 1F. On the other hand, machinability is not industrially satisfactory when, for any of the four cutting tests (i.e., lathe cutting at 60, 120 and 200 m/min and drill cutting at 80 m/min), the chips yielded are either intermediate rectangular shaped (i.e., length 25 mm to 75 mm) as shown in FIG. 1D, or long chips (i.e., length >75 mm) as shown in FIG. 1E, or long spirals with >3 windings as shown in FIG. 1G.

For example, First Invention Alloys ("FIA") Nos. 1A and 1 B have the same composition, include a metal construction with an α phase matrix and both γ and κ phases, with no β phase. The difference between these alloys is that FIA 1A was extruded and FIA 1B was cast. FIA Nos. 1A and 1B respectively demonstrate good tensile strength of 517 and 416 $N/mm^2$, and excellent machinability as demonstrated by the yield of desirable arch chips or short rectangular chips during lathe cutting and drill cutting. Furthermore, the cutting force required to machine FIA 1A and FIA 1B is reasonable (i.e., about 105 to 119 N). On the other hand, Comparison Alloy ("CA") No. 1 is slightly different in composition from FIA 1A and FIA 1B, having 0.002 percent lead, by weight, which results in a change in the nature of chips yielded at higher cutting speeds (i.e., 80, 120 and 200 m/min) to short spiral-shaped chips. Thus, by decreasing lead content slightly from that in FIA No. 1A to the content in CA No. 1, the machinability of an alloy can degrade from excellent to merely industrially satisfactory.

FIA Nos. 2 and 3 were made in extruded and cast forms. The two forms manifest similar characteristics except that tensile strength is substantially higher in the extruded samples. Both FIA No. 2 and FIA No. 3 yielded either arch chips or short rectangular chips during industrial lathe and drill cutting conditions upon application of a reasonable cutting force. Therefore, FIA Nos. 2 and 3 manifest excellent machinability characteristics. FIA Nos. 1A, 1B, 2 and 3 also demonstrated good corrosion resistance (i.e., maximum corrosion depth was 140-160 μm). Only FIA No. 2 was tested for erosion corrosion resistance, which was good at 60 mg weight loss. Lead leachability was also desirably low for FIA Nos. 1A, 2 and 3, with lead leachates ranging 0.001 to 0.006, g, mg/L, of lead respectively. FIA No. 11 is another first invention alloy with excellent machinability (i.e., produces either arch shape, needle shape, or plate shape chips).

CA Nos. 4 and 5 demonstrate the effect of increasing lead on the lead leachability of a cast alloy. CA Nos. 4 and 5 included 0.28 and 0.55 percent lead, by weight, respectively, and the lead leachate for these alloys were 0.015 and 0.026 g, mg/L, of lead, respectively, which was about 2.5 to 26 times higher than for low lead alloys made in accordance with the first invention alloy. On the other hand, CA No. 6, extruded at 750° C. demonstrates the effect on machinability of diminishing the percent of lead, by weight, in Cu—Si—Zn alloys. With lead less than 0.005, percent, by weight, increased cutting forces are often required and the chips yielded become undesirably long rectangular chips of between 25-75 mm or spiral chips with more than three windings. In other words, the machinability of CA No. 6 is not industrially satisfactory.

FIA No. 7 demonstrates that not all first invention alloys will have industrially satisfactory machinability. As explained above, machinability depends on the elemental content of an alloy and on the metal phase construction. Therefore, in accordance with the eleventh invention alloy, the further limiting relationship $18-500Pb \leqq \kappa+\gamma+0.3\mu-\beta \leqq 56+500Pb$ is employed to selectively identify additional alloys with industrially satisfactory machinability. As evident from Table 1, FIA No. 7 does not fall within the scope of an eleventh invention alloy.

FIA No. 8 demonstrates the effects the manufacturing methods employed may have on the machinability characteristics of a metal alloy of the present invention. Specifically, FIA No. 8 is provided in extruded and cast forms including a form extruded at 750° C., a form extruded at 650° C., a form cast, and a cast form subsequently subjected to heat treatment at 550° C. for 50 minutes. As can be seen from these four forms of FIA No. 8, the increasing presence of β phase has a detrimental effect on machinability. In particular, the cast form has the least desirable machinability and a 4% β phase, whereas the extruded forms have the lowest amount of γ phase and excellent machinability. In accordance with the eighth invention alloy, when the cast form of FIA No. 8 is subjected to heat treatment (e.g., 550° C. for 50 minutes in this example), β phase is converted so the percentage of γ+κ phases increases. With this increase in the γ+κ phase percentage comes an improved machinability (i.e., required cutting force decreases, and the chips yielded by cutting change from medium length and long rectangular chips to arch chips or short rectangular chips as demonstrated by Table 1). Thus, the heat treated cast form of FIA No. 8 has excellent machinability.

CA No. 9 and FIA No. 10 demonstrate the effect of lead in an extruded alloy having an a phase matrix and γ, κ and μ phases. In particular, FIA No. 10 is provided in four forms, an form extruded at 750° C., an form extruded at 750° C. that subsequently underwent heat treatment at 490° C. for 100 min, a form extruded at 650° C., and a cast form. As seen from Table 1, CA No. 9 and the form of FIA No. 10 extruded at 750° C. have similar cutting characteristics. On the other hand, forms of FIA No. 10 either extruded at 650° C. or cast have industrially satisfactory machinability, yielding either arch chips or short rectangular chips throughout the range of cutting tests. It is also shown that by subjecting the form of FIA No. 10 extruded at 750° C. to a heat treatment, in accordance with the present invention, an eighth invention alloy having industrially satisfactory machinability results.

CA Nos. 13 and 14 demonstrate the importance of the relationship $61-50Pb \leqq X-4Y \leqq 66+50Pb$ between percentages of lead, copper and silicon for first invention alloys. CA Nos. 13 and 14 do not meet this limitation, and are not alloys falling within the scope of the present invention. The machinability of CA Nos. 13 and 14 are not industrially satisfactory.

FIA No. 15, when cast, is an alloy in accordance with the present invention with excellent machinability. However, this embodiment demonstrates that extruded forms of this alloy, when formed by extrusion at 750° C. and 650° C., manifest substantially different machinability characteristics at higher cutting speeds (i.e., 80, 120 and 200 m/min). As shown in Table 1, the extruded forms of this alloy have a metal construction that does not satisfy the relationship $18-500Pb \leqq \kappa+\gamma+0.3\mu-\beta \leqq 56+500Pb$. Consequently, while all three forms of FIA No. 15 are first invention alloys, only the cast form has industrially satisfactory machinability. The cast form of FIA No. 15 is also an eleventh invention alloy.

FIA Nos. 16 and 17 are extruded first invention alloys having excellent machinability. FIA No. 17A has the substantially the same elemental composition as FIA No. 17, but has been extruded at a lower temperature. In embodiment FIA No. 17A there is an excessive amount of μ phase (i.e., $\mu>20\%$) is not industrially satisfactory. Thus, FIA Nos. 17 and 17A reemphasize that alloys having the same elemental composition may have substantially different metal construction and substantially different machinability characteristics.

CA Nos. 18 to 23 are all alloys extruded at 750° C. having exceptionally poor machinability characteristics and require relatively high cutting forces (i.e., 130-195 N) to cut. CA No. 18 is an alloy that does not satisfy the relationship $61-50Pb \leqq X-4Y \leqq 66+50Pb$, and it also has a pure a phase metal construction. CA Nos. 19 and 21 also have single phase metal constructions consisting of the α phase, although CA No. 19 has too little silicon and CA No. 21 has too much copper when compared to elemental composition of first invention alloys. As discussed, alloys having a single a phase metal construction are expected to have industrially unacceptable machinability. CA Nos. 20 and 23 manifest a relatively large β phase (i.e., $\beta>5\%$), which degrades machinability. CA No. 22 has an excessive amount of copper, and its a phase is only 20% of the metal construction, which are probably the reasons for the industrially unsatisfactory machinability of this alloy.

FIA Nos. 24 to 26 each have excellent machinability in accordance with first invention alloys of the present invention. FIA No. 27 is provided to show that an otherwise acceptable elemental composition may have industrially unsatisfactory machinability when the amount of contaminating iron present is greater than 0.5%, by weight, of the metal alloy.

Results in Table 2

Table 2 is a compilation of second and third invention alloys, and relevant comparison alloys. More specifically, Alloys Nos. 2, 3, 7, 8, 10, 11, 14 and 14B all fall within the scope of the second invention alloy. Alloys Nos. 15, 16, 17, 18, 19, 21, 22, 23 and 24 all fall within the scope of the third invention alloy. Alloys Nos. 1, 4, 5, 6, 9, 12, 13, 20, 25, 26, 27, 28, 29 and 30 are more comparison alloys and do not fall within the scope of the present invention. Of note, Alloy No. 25 corresponds to prior art alloy JIS: C3604, CDA: C36000; Alloy No. 26 corresponds to prior art alloy JIS: C3771, CDA: C37700; Alloy No. 27 corresponds to prior art alloy JIS: CAC802, CDA: C87500; Alloy No. 28 corresponds to prior art alloy JIS: CAC203, CDA: C85700; Alloy No. 29 corresponds to prior art alloy JIS: CAC406, CDA: C83600; and Alloy No. 30 corresponds to prior art alloy JIS: C2800, CDA: C2800.

As shown by Table 2, Second Invention Alloys ("SIA") Nos. 2 and 3 contain phosphorous and are provided in extruded and cast forms. SIA No. 3 additionally includes antimony. SIA Nos. 2 and 3 include a metal construction with an a phase matrix and both γ and κ phases, with no β phase. SIA Nos. 2 and 3 respectively demonstrate good tensile strength of around 525 $N/mm^2$ for the extruded form and around 426 $N/mm^2$ for the cast form, and excellent machinability as demonstrated by the yield of desirable arch chips or short rectangular chips during lathe cutting and drill cutting. Furthermore, the cutting force required to machine SIA Nos. 2 and 3 is reasonable (i.e., about 98 to 112 N). On the other hand, Comparison Alloy ("CA") No. 1 is slightly different in composition from SIA No. 2, having 0.002 percent lead, by weight, which results in a change in the nature of chips yielded at higher lathe cutting speeds (i.e., 120 and 200 m/min) to short spiral-shaped chips. Thus, by decreasing lead content slightly from that in SIA No. 2 to the content in CA No. 1, the machinability of an alloy can degrade from excellent to merely industrially satisfactory.

SIA Nos. 2 and 3 were made in extruded and cast forms. The two forms manifest similar characteristics except that tensile strength is substantially higher in the extruded samples. Both SIA No. 2 and SIA No. 3 yielded either arch chips or short rectangular chips during industrial lathe and drill cutting conditions upon application of a reasonable cutting force. Therefore, SIA Nos. 2 and 3 manifest excellent machinability characteristics. SIA Nos. 2 and 3 also demonstrated good corrosion resistance (i.e., maximum corrosion depth was <10 μm) as a result of the addition of phosphorous. Only SIA No. 2 was tested for erosion corrosion resistance, which was good at 50 to 55 mg weight loss. Lead leachability was also desirably low for SIA Nos. 2 and 3, with lead leachates ranging <0.001 to 0.005, g, mg/L, of lead respectively. SIA Nos. 11, 14 and 14B are other second invention alloys containing phosphorous and demonstrating excellent machinability (i.e., produces either arch shape, needle shape, or plate shape chips), good tensile strength and good corrosion resistance.

CA Nos. 4 and 5 demonstrate the effect of increasing lead on the lead leachability of a cast alloy. CA Nos. 4 and 5 included 0.29 and 0.048 percent lead, by weight, respectively, and the lead leachate for these alloys were 0.015 and 0.023 g, mg/L, of lead, respectively, which was substantially higher than for low lead alloys made in accordance with the second invention alloy. It is noted that CA No. 28, corresponding to JIS: CAC203, CDA: C85700, is a cast prior art alloy containing phosphorous and lead, having excellent machinability, and good corrosion resistance. However, as compiled in Table 2, the tensile strength, of this alloy is about one-half of the tensile strength of the second invention alloys of the present invention and the lead leachate of the prior art alloy contains about 78 times more lead than the leachate from a second invention alloy of the present invention. On the other hand, CA No. 6, extruded at 750° C. demonstrates the effect on machinability of diminishing the percent of lead, by weight, in Cu—Si—Zn alloys. With lead less than 0.005, percent, by weight, increased cutting forces are often required and the chips yielded become undesirably long rectangular chips of between 25-75 mm or spiral chips with more than three windings. In other words, the machinability of CA No. 6 is not industrially satisfactory.

SIA No. 7 demonstrates that not all second invention alloys will have industrially satisfactory machinability. As explained above, machinability depends on the elemental content of an alloy and on the metal phase construction. Therefore, in accordance with the eleventh invention alloy, the further limiting relationship $18-500Pb \leqq \kappa+\gamma+0.3\mu-\beta \leqq 56+500Pb$ is employed to selectively identify additional alloys with industrially satisfactory machinability. As evident from Table 2, SIA No. 7 does not fall within the scope of an eleventh invention alloy.

SIA No. 8 demonstrates the effects the manufacturing methods employed may have on the machinability characteristics of a metal alloy of the present invention. Specifically, SIA No. 8 is provided in extruded and cast forms including a form extruded at 750° C., a form extruded at 650° C. and a form cast. As can be seen from these three forms of SIA No. 8, the increasing presence of β phase has a detrimental effect on machinability. In particular, the cast form has the least desirable machinability and a 5% β phase, whereas the extruded forms have the lowest amount of β phase and excellent machinability. Thus, whether an alloy is cast or extruded may have an effect on whether the alloy will have excellent machinability or not meet the requirements of industrially satisfactory machinability.

CA No. 9 and SIA No. 10 demonstrate the effect of lead in an extruded alloy having an α phase matrix and γ, κ, and μ phases. In particular, SIA No. 10 is provided in four forms, a form extruded at 750° C., a form extruded at 750° C. that subsequently underwent heat treatment at 580° C. for 20 min, a form extruded at 650° C., and a cast form. As seen from Table 2, CA No. 9 and the form of SIA No. 10 extruded at 750° C. have similar cutting characteristics. On the other hand, forms of SIA No. 10 either extruded at 650° C. or cast have industrially satisfactory machinability, yielding either arch chips or short rectangular chips throughout the range of cutting tests. It is also shown that by subjecting the form of SIA No. 10 extruded at 750° C. to a heat treatment, in accordance with the present invention, an eighth invention alloy having industrially satisfactory machinability results.

CA Nos. 12 and 13 demonstrate the importance of the relationship $61-50Pb \leqq X-4Y+aZ \leqq 66+50Pb$ between percentages of lead, copper, silicon and the other elements selected for second invention alloys. CA Nos. 13 and 14 do not meet this limitation, and are not alloys falling within the scope of the present invention. The machinability of CA Nos. 13 and 14 are not industrially satisfactory.

As shown by Table 2, Third Invention Alloys ("TIA") Nos. 15, 16, 17, 18 and 19 contain manganese or nickel and are provided in extruded form. These illustrative embodiments, in accordance with the third invention alloy include a metal construction with an a phase matrix and both γ and κ phases, with no β phase. These alloys tend to have increased tensile strength over the second invention alloys. TIA Nos. 15, 16, 17, 18 and 19 also demonstrate excellent machinability as demonstrated by the yield of desirable arch chips or short rectangular chips during lathe cutting and drill cutting. Furthermore, the cutting force required to machine TIA Nos. 15, 16, 17, 18 and 19 is reasonable (i.e., about 112 to 129 N). On the other hand, CA No. 20 is an alloy that does not satisfy the relationship of formula (1). Consequently, the machinability of this alloy in not industrially satisfactory and the alloy yields undesirable spiral chips having 3 or more windings.

TIA Nos. 21, 22, 23 and 24 demonstrate that not all third invention alloys have industrially satisfactory machinability. For example, TIA Nos. 21 and 23 have an excessive amount of β phase (i.e., β phase is 10%, which is >5% β phase). During cutting, TIA No. 21 yields undesirable spiral cuttings with more than 3 windings. TIA No. 23 yields undesirable spiral cuttings with more than 3 windings during drill cutting, and undesirably long chips during lathe cutting at higher speeds. However, TIA No. 24 corresponds to a heat treated form of TIA No. 23. TIA No. 24 has only 3% β phase due to the conversion of β phase to γ and/or κ phases during heat treatment. TIA No. 24 has excellent industrially satisfactory machinability. TIA No. 22 includes a small amount of iron (Fe=0.35, percent, by weight) and yields desirable plate chips during lathe cutting, but undesirable medium length rectangular chips during drill cutting. Therefore, TIA No. 22 exhibits machinability that is not industrially satisfactory.

CA Nos. 25 to 30 demonstrate various disadvantages of Cu—Zn alloys of the prior art. CA Nos. 25, 26 and 28 have no silicon, no γ and/or κ phases, and a relatively high amount of lead. While these metal alloys have industrially satisfactory machinability, it is achieved by the relatively high amount of lead. As a result, the lead leachability is high with lead leachates of 0.35, 0.29, and 0.39 mg/L, respectively, which is unacceptably high for industrial application to systems for providing drinking water, for example. CA No. 27, on the other hand, has an excessive amount of copper and a metal construction comprising 85% κ phase. This means there is only about 15% alpha phase, so CA No. 27 does not have an alpha phase matrix. As can be seen from Table 2, CA No. 27 does not have industrially satisfactory machinability. CA No. 29 is an alloy with low amounts of copper, high amounts of zinc and lead. While CA No. 29 demonstrates diminishing machinability characteristics as the lathe cutting speed increases (i.e., from 60 to 120 to 200 m/min, chips yielded change from arch to plate to intermediate rectangular chips). Besides CA No. 29 not having industrially satisfactory machinability, it also has high lead leachability with lead leachate of 0.21 mg/L. Lastly, CA No. 30 is a Cu—Zn alloy having no silicon and only low amounts of lead (i.e., lead is 0.01, percent, by weight). This alloy, however, has an alpha phase matrix with 10% β phase dispersed therein. There are no γ and/or κ phases. Since CA No. 30 has neither high amounts of lead, nor γ and/or κ phases, it is an alloy with extremely poor industrial machinability.

CA Nos. 25 to 30 demonstrate the complex, multifactorial effects of elemental composition, lead content, and metal construction on the machinability of Cu—Zn alloys. While high amounts of lead may improve machinability, it comes with the cost of high lead leachability. On the other hand, Cu—Zn alloys with low lead content tend to have metal constructions that do not provide industrially satisfactory machinability. On the other hand, first invention alloys, second invention alloys, and third invention alloys of the present invention take advantage of a synergistic effect between a relatively small amount of lead (i.e., 0.005 up to but less than 0.02 percent, by weight, of lead), and the presence of machinability enhancing γ and/or κ phases in an alpha phase matrix, to obtain industrially satisfactory Cu—Zn metal alloys that are safe for the environment because they do not leach out appreciable amounts of lead.

While the present invention has been described with reference to certain preferred embodiments, one of ordinary skill in the art will recognize that additions, deletions, substitutions, modifications and improvements can be made while remaining within the spirit and scope of the present invention as defined by the appended claims.

TABLE 1

First Invension alloys and comparative alloys

| | Cu | Si | Pb | Zn | Other element | Extrusion Temp. or Cast, H.T. (° C.) | Metal Phase constr. | γ + κ (%) | β (%) | μ (%) | Cu − 4Si + X + 5 0 Pb (%) | Cu − 4Si + X − 50 Pb (%) | Cu − 4Si + X (%) | γ + κ + 0.3 μ − β (%) | γ + κ + 0.3 μ − β +500 Pb (%) | γ + κ + 0.3 μ − β −500 Pb (%) |
|---|---|---|---|---|---|---|---|---|---|---|---|---|---|---|---|---|
| | 71.5-78.5 | 2.0-4.5 | 0.005-0.02 | REM | | | | | 0~5 | 0~20 | 61≧ | ≦66 | | 18≧ | ≦56 | |
| 1 | 76 | 3.1 | 0.002 | 20.9 | — | 750 | α + γ + κ | 25 | 0 | 0 | 63.7 | 63.5 | 63.6 | 25 | — | — |
| 1A | 76.2 | 3.1 | 0.005 | 20.7 | | 750 | α + γ + 78 | 25 | 0 | 0 | 64.1 | 63.6 | 63.8 | 25 | 27.5 | 22.5 |
| 1B | 76.2 | 3.1 | 0.005 | 20.7 | | As Cast | α + γ + κ | | 25 | 0 | 0 | 64.1 | 63.8 | 25 | 27.5 | 22.5 |
| 2 | 76.1 | 3.1 | 0.01 | 20.8 | — | 750 | α + γ + κ | 25 | 0 | 0 | 64.1 | 63.4 | 63.7 | 25 | 28.5 | 21.5 |
| | 76.1 | 3.1 | 0.007 | 20.8 | | As Cast | α + γ + κ | 25 | 0 | 0 | 64.1 | 63.7 | 25 | 28.5 | 21.5 | |
| 3 | 75.8 | 3.1 | 0.012 | 21.1 | — | 750 | α + γ + κ | 25 | 0 | 0 | 64.0 | 62.8 | 63.4 | 25 | 31.0 | 19 |
| | 75.8 | 3.1 | 0.012 | 21.1 | | As Cast | α + γ + κ | 25 | 0 | 0 | 64.0 | 62.8 | 63.4 | 25 | 31.0 | 19 |
| 4 | 75.9 | 3.1 | 0.028 | 21.0 | — | As Cast | α + γ + κ | 25 | 0 | 0 | 64.9 | 62.1 | 63.5 | 25 | — | — |
| 5 | 75.8 | 3.1 | 0.055 | 21.0 | — | As Cast | α + γ + κ | 25 | 0 | 0 | 66.2 | 60.7 | 63.4 | 25 | — | — |
| 6 | 72.2 | 2.5 | 0.002 | 25.3 | — | 750 | α + γ + β | 15 | 3 | 0 | 62.3 | 62.1 | 62.2 | 12 | 13.0 | 11 |
| 7 | 72 | 2.5 | 0.007 | 25.5 | — | 750 | α + γ + β | 15 | 3 | 0 | 62.4 | 61.7 | 62 | 12 | 15.5 | 8.5 |
| 8 | 72.1 | 2.5 | 0.012 | 25.4 | — | 750 | α + γ + β | 15 | 2 | 0 | 62.7 | 61.5 | 62.1 | 13 | 19.0 | 7 |
| | 72.1 | 2.5 | 0.012 | 25.4 | — | 650 | α + γ + β | 15 | 1 | 0 | 62.7 | 61.5 | 62.1 | 14 | 20.0 | 8 |
| | 72.1 | 2.5 | 0.012 | 25.4 | — | As Cast | α + γ + β | 15 | 4 | 0 | 62.7 | 61.5 | 62.1 | 11 | 17.0 | 5 |
| | 72.1 | 2.5 | 0.012 | Castings, Heat treatment, 550° C. × 50 min | | | | 20 | 0 | 0 | 62.7 | 61.5 | 62.1 | 20 | 26.0 | 14 |
| 9 | 78 | 3.6 | 0.003 | 24.9 | — | 750 | α + γ + κ + μ | 60 | 0 | 5 | 63.8 | 63.5 | 63.6 | 61.5 | 63.0 | 60 |
| 10 | 77.8 | 3.6 | 0.007 | 18.6 | — | 750 | α + γ + κ + μ | 60 | 0 | 5 | 63.8 | 63.1 | 63.4 | 61.5 | 65.0 | 58 |
| | 77.8 | 3.6 | 0.007 | Heat treatment, 490° C. × 100 min | | | | 55 | 0 | 7 | 63.8 | 63.1 | 63.4 | 57.1 | 60.6 | 53.6 |
| | 77.8 | 3.6 | 0.007 | 18.6 | — | 650 | α + γ + κ + μ | 55 | 0 | 10 | 63.8 | 63.1 | 63.4 | 58 | 61.5 | 54.5 |
| | 77.8 | 3.6 | 0.007 | 18.6 | — | As Cast | α + γ + κ + μ | 55 | 0 | 3 | 63.8 | 63.1 | 63.4 | 55.9 | 59.4 | 52.4 |
| 11 | 77.6 | 3.7 | 0.015 | 18.7 | — | 750 | α + γ + κ | 60 | 0 | 5 | 63.6 | 62.1 | 62.8 | 61.5 | 69.0 | 54 |
| 13 | 74 | 3.5 | 0.014 | 22.5 | — | 750 | α + γ + κ + β | 25 | 10 | 0 | 60.7 | 59.3 | 60 | 15 | 22.0 | 8 |
| 14 | 77.8 | 2.7 | 0.016 | 19.5 | — | 750 | α + κ + μ | 8 | 0 | 15 | 67.8 | 66.2 | 67 | 12.5 | 20.5 | 4.5 |
| 15 | 78 | 3.9 | 0.009 | 18.1 | — | 750 | α + γ + κ + μ | 65 | 0 | 1 | 62.9 | 62.0 | 62.4 | 65.3 | 69.8 | 60.8 |
| | 78 | 3.9 | 0.009 | 18.1 | — | 650 | α + γ + κ + μ | 60 | 0 | 3 | 62.9 | 62.0 | 62.4 | 60.9 | 65.4 | 56.4 |
| | 78 | 3.9 | 0.009 | 18.1 | — | As Cast | α + γ + κ | 60 | 0 | 0 | 62.9 | 62.0 | 62.4 | 60 | 64.5 | 55.5 |
| 16 | 77 | 3.9 | 0.008 | 19.1 | — | 750 | α + γ + κ + β | 55 | 4 | 0 | 61.8 | 61.0 | 61.4 | 51 | 55.0 | 47 |
| 17 | 77.5 | 2.8 | 0.017 | 19.7 | — | 750 | α + κ + μ | 10 | 0 | 10 | 67.2 | 65.5 | 66.3 | 13 | 21.5 | 4.5 |
| 17A | 77.5 | 2.8 | 0.017 | 19.7 | — | 650 | α + κ + μ | 5 | 0 | 25 | 67.2 | 65.5 | 66.3 | 12.5 | 21.0 | 4 |
| 18 | 77.8 | 2.2 | 0.015 | 20.0 | — | 750 | α | 0 | 0 | 0 | 69.8 | 68.3 | 69 | o | 7.5 | −7.5 |
| 19 | 76.9 | 1.8 | 0.01 | 21.3 | — | 750 | α | 0 | 0 | 0 | 70.2 | 69.2 | 69.7 | 0 | 5.0 | −5 |

TABLE 1-continued

First Invension alloys and comparative alloys

| | | | | | | | | | | | | | | | | |
|---|---|---|---|---|---|---|---|---|---|---|---|---|---|---|---|---|
| 20 | 77 | 4.6 | 0.01 | 18.4 | — | 750 | α + γ + κ + β | 65 | 15 | 0 | 59.1 | 58.1 | 58.6 | 50 | 55.0 | 45 |
| 21 | 79.3 | 2.3 | 0.01 | 18.4 | — | 750 | α | 0 | 0 | 0 | 70.6 | 89.6 | 70.1 | 0 | 5.0 | −5 |
| 22 | 79.5 | 4 | 0.01 | 16.5 | — | 750 | α + κ + μ | 80 | 0 | 0 | 64.0 | 63.0 | 63.5 | 80 | 85.0 | 75 |
| 23 | 71 | 2.8 | 0.01 | 26.2 | — | 750 | α + γ + β | 10 | 15 | 0 | 60.3 | 59.3 | 59.8 | −5 | 0.0 | −10 |
| 24 | 77.2 | 3.3 | 0.01 | 19.5 | — | 750 | α + γ + κ | 35 | 0 | 2 | 64.5 | 63.5 | 64 | 35.6 | 40.6 | 30.6 |
| 25 | 76.2 | 3.1 | 0.01 | 20.7 | Bi:0.015, Se:0.04 | | α + γ + κ | 30 | 0 | 0 | 64.3 | 63.3 | 63.8 | 30 | 35.0 | 25 |
| 26 | 75 | 2.8 | 0.01 | 22.2 | Te:0.07 | 750 | α + γ + κ | 25 | 0 | 0 | 64.3 | 63.3 | 63.8 | 25 | 30.0 | 20 |
| 27 | 74.8 | 2.6 | 0.01 | 22.6 | Fe:0.53 | 750 | α + γ + κ | 15 | 0 | 0 | 64.9 | 63.9 | 64.4 | 15 | 20.0 | 10 |

| | Condition of Chips 60 m/min | 120 m/min | 200 m/min | Cutting Force (N) 60 m/min | 120 m/min | 200 m/min | Condition of Chips Drilling 90 m/min | Tensile strength N/mm2 | Elongation % | Pb leaching, mg/L | ISO6509 Maxmium Corrosion Depth (μm) | Erosion corrosion, weight loss (mg) |
|---|---|---|---|---|---|---|---|---|---|---|---|---|
| 1 | ◎ | Δ | Δ | 109 | 134 | 145 | Δ | | | | | |
| 1A | ◎ | ◎ | ○ | 107 | 112 | 119 | ◎ | 517 | 39 | | 140 | |
| 1B | ◎ | ◎ | ○ | 105 | 109 | 117 | ◎ | 416 | 28 | 0.001 | 150 | |
| 2 | ◎ | ◎ | ○ | 105 | 105 | 109 | ◎ | 515 | 39 | | 150 | 60 |
| | ◎ | ◎ | ○ | 102 | 104 | 107 | ◎ | 407 | 26 | 0.002 | 150 | 60 |
| 3 | ◎ | ◎ | ◎ | 99 | 101 | 105 | ◎ | 520 | 38 | | 160 | |
| | ◎ | ◎ | ◎ | 59 | 102 | 104 | ◎ | 412 | 25 | 0.006 | 160 | |
| 4 | — | — | — | | | | | | | 0.015 | | |
| 5 | — | — | — | | | | | | | 0.026 | | |
| 6 | ▲ | ▲ | x x | 133 | 148 | 175 | ▲ | | | | | |
| 7 | ▲ | ▲ | x | 128 | 139 | 159 | ▲ | | | | | |
| 8 | ◎ | ○ | ○ | 112 | 120 | 129 | ◎ | 474 | 24 | | | |
| | ◎ | ○ | ○ | 112 | 119 | 128 | ◎ | 483 | 26 | | | |
| | ▲ | ▲ | x | 129 | 140 | 159 | ▲ | 378 | 18 | 0.005 | | |
| | ◎ | ○ | ○ | 115 | 123 | 130 | ◎ | 390 | 22 | | | |
| 9 | ○ | Δ | x | 118 | 144 | 175 | ▲ | | | | | |
| 10 | ○ | Δ | Δ | 118 | 140 | 147 | ▲ | 545 | 30 | | | |
| | ◎ | ○ | ○ | 114 | 122 | 126 | ◎ | 532 | 32 | | | |
| | ◎ | ○ | ○ | 116 | 124 | 129 | ◎ | 538 | 28 | | | |
| | ◎ | ○ | ○ | 110 | 118 | 124 | ◎ | 424 | 22 | 0.003 | | |
| 11 | ◎ | ○ | ○ | 114 | 119 | 126 | ◎ | | | | | |
| 13 | ▲ | ▲ | x x | 129 | 145 | 168 | x x | | | | | |
| 14 | ◎ | ▲ | ▲ | 119 | 141 | 149 | ▲ | | | | | |

TABLE 1-continued

| First Invension alloys and comparative alloys | | | | | | | | | | | |
|---|---|---|---|---|---|---|---|---|---|---|---|
| 15 | ◎ | ▲ | ▲ | 123 | 143 | 151 | ▲ | | | | |
| | ◎ | ○ | ▲ | 119 | 129 | 148 | ▲ | | | | |
| | ◎ | ○ | ○ | 118 | 127 | 133 | ◎ | | | 0.002 | |
| 16 | ○ | ○ | ○ | 122 | 128 | 131 | ◎ | | | | |
| 17 | ○ | ○ | ○ | 116 | 124 | 134 | ◎ | 472 | 32 | | |
| 17A | ○ | ○ | ▲ | 117 | 129 | 145 | ▲ | 451 | 14 | | |
| 18 | x x | x x | x x | 162 | 174 | 189 | x x | | | | |
| 19 | x x | x x | x x | 168 | 180 | 194 | x x | | | | |
| 20 | ▲ | x x | x x | 145 | 173 | 178 | x x | | | | |
| 21 | x x | x x | x x | 170 | 180 | 195 | x x | | | | |
| 22 | ▲ | x | x | 134 | 151 | 168 | x x | | | | |
| 23 | ▲ | x x | x | 130 | 162 | 185 | x x | | | | |
| 24 | ◎ | ◎ | ○ | 103 | 105 | 109 | ◎ | 532 | 34 | | 130 |
| 25 | ● | ◎ | ◎ | 99 | 102 | 105 | ◎ | 515 | 36 | | 150 |
| 26 | ◎ | ◎ | ○ | 101 | 103 | 106 | ◎ | 485 | 33 | | |
| 27 | ◎ | ▲ | ▲ | 119 | 134 | 143 | ◎ | | | | |

Forms of the chips represented by:
◎ Arch or Circular arch
○ Rectangular (length: <25 mm)
● Needle
▲ Rectangular (length: 25-75 mm)
Δ Spiral with 1-3 windings
x Rectangular (length: >75 mm)
x x Spiral with >3 windings

TABLE 2

2nd, 3rd Invension alloys and comparative alloys

| | Cu 71.5–78.5 | Si 2.0–4.5 | Pb 0.005–0.02 | Zn REM | Al 0.1–2.0 | Sn 0.1–1.2 | Mn 0.3–4.0 | Ni 0.2–3.0 | P 0.01–0.2 | Other element | Extrusion Temp, or Cast, H.T. (° C.) |
|---|---|---|---|---|---|---|---|---|---|---|---|
| 1 | 75.8 | 3 | 0.002 | 21.1 | 0 | 0 | 0 | 0 | 0.06 | — | 750 |
| 2 | 76 | 3 | 0.008 | 20.9 | 0 | 0 | 0 | 0 | 0.08 | — | 750 |
| | 76 | 3 | 0.008 | 20.9 | 0 | 0 | 0 | 0 | 0.08 | — | As Cast |
| 3 | 75.6 | 3 | 0.013 | 21.2 | 0 | 0 | 0 | 0 | 0.10 | Sb: 0.05 | 750 |
| | 75.6 | 3 | 0.013 | 21.2 | 0 | 0 | 0 | 0 | 0.10 | Sb: 0.05 | As Cast |
| 4 | 75.9 | 3 | 0.029 | 21.0 | 0 | 0 | 0 | 0 | 0.08 | — | As Cast |
| 5 | 75.5 | 3 | 0.048 | 21.4 | 0 | 0 | 0 | 0 | 0.08 | — | As Cast |
| 6 | 72.5 | 2.2 | 0.002 | 24.5 | 0.7 | 0 | 0 | 0 | 0.05 | — | 750 |
| 7 | 72.4 | 2.2 | 0.007 | 24.6 | 0.7 | 0 | 0 | 0 | 0.05 | As: 0.04 | 750 |
| 8 | 72.6 | 2.2 | 0.012 | 24.3 | 0.8 | 0 | 0 | 0 | 0.12 | — | 750 |
| | 72.6 | 2.2 | 0.012 | 24.3 | 0.8 | 0 | 0 | 0 | 0.12 | — | 650 |
| | 72.6 | 2.2 | 0.012 | 24.3 | 0.8 | 0 | 0 | 0 | 0.12 | — | As Cast |
| 9 | 78.3 | 3.7 | 0.003 | 24.9 | 0 | 0 | 0 | 0 | 0.06 | — | 750 |
| 10 | 78.1 | 3.7 | 0.007 | 18.1 | 0 | 0 | 0 | 0 | 0.07 | — | 750 |
| | 78.1 | 3.7 | 0.007 | 18.1 | 0 | 0 | 0 | 0 | 0.07 | Heat treatment, 580° C. × 20 min | |
| | 78.1 | 3.7 | 0.007 | 18.1 | 0 | 0 | 0 | 0 | 0.07 | — | 650 |
| | 78.1 | 3.7 | 0.007 | 18.1 | 0 | 0 | 0 | 0 | 0.07 | — | As Cast |
| 11 | 78.3 | 2.9 | 0.008 | 20.7 | 0 | 0.3 | 0 | 0 | 0.07 | Bi0.018 | As Cast |
| 12 | 74.1 | 3.2 | 0.012 | 22.7 | 0 | 1.1 | 0 | 0 | 0.00 | — | 750 |
| 13 | 77.9 | 2.1 | 0.018 | 19.6 | 0.4 | 0 | 0 | 0 | 0.00 | — | 750 |
| 14 | 76.5 | 3 | 0.009 | 20.4 | 0 | 0.5 | 0 | 0 | 0.03 | — | 750 |
| 14B | 77.2 | 2.9 | 0.01 | 20.4 | 0.6 | 0 | 0 | 0 | 0.05 | — | 750 |
| 15 | 71.8 | 4.3 | 0.015 | 20.4 | 0 | 0 | 3.4 | 0 | 0.05 | — | 750 |
| 16 | 74.6 | 4.3 | 0.01 | 17.8 | 0.5 | 0 | 2.8 | 0 | 0.00 | Te: 0.05 | 750 |
| 17 | 74.7 | 3.4 | 0.01 | 21.3 | 0 | 0.3 | 0.6 | 0 | 0.00 | — | 750 |
| 18 | 74.3 | 3.4 | 0.01 | 21.4 | 0 | 0 | 0 | 0.8 | 0.00 | Sb: 0.05 | 750 |
| 19 | 77.5 | 3.6 | 0.01 | 16.0 | 1.6 | 0 | 1.3 | 0 | 0.00 | — | 750 |
| 20 | 71.6 | 2.6 | 0.01 | 22.0 | 0 | 0 | 3.8 | 0 | 0.00 | — | 750 |
| 21 | 71.8 | 2.7 | 0.01 | 20.4 | 2 | 0.8 | 3.2 | 0 | 0.05 | — | 750 |
| 22 | 74.5 | 3.5 | 0.01 | 20.6 | 0 | 0 | 1 | 0 | 0.00 | Fe: 0.35 | 750 |
| 23 | 72 | 3.6 | 0.01 | 23.0 | 0 | 0 | 1.4 | 0 | 0.00 | — | As Cast |
| 24 | 72 | 3.6 | 0.01 | 23.0 | 0 | 0 | 1.4 | 0 | 0.00 | Heat treatment, 520° C. × 40 min | |
| 25 | 60.5 | 0 | 2.9 | 36.3 | 0 | 0.2 | 0 | 0 | 0.00 | Fe: 0.25 | 750 |
| | | | | | | | | | | | As Cast |
| 26 | 58.5 | 0 | 2 | 39.2 | 0 | 0.2 | 0 | 0 | 0.00 | Fe: 0.25 | 750 |
| | | | | | | | | | | | As Cast |
| 27 | 81.2 | 4.1 | 0.01 | 14.7 | 0 | 0 | 0 | 0 | 0.00 | — | As Cast |
| 28 | 84.5 | 0 | 5.2 | 5.7 | 0 | 4.6 | 0 | 0 | 0.05 | — | As Cast |
| 29 | 60.8 | 0 | 1.2 | 38.0 | 0 | 0.7 | 0 | 0 | 0.00 | — | As Cast |
| 30 | 61 | 0 | 0.01 | 39.0 | 0 | 0 | 0 | 0 | 0.00 | | 750 |
| | | | | | | | | | | — | As Cast |

| | Metal Phase constr. | γ + κ (%) | β (%) 0~5 | μ (%) 0~20 | Cu − 4Si + X + 50Pb (%) 61≧ | Cu − 4Si + X − 50Pb (%) ≦66 | Cu − 4Si + X (%) 61–66 | γ + κ + 0.3μ − β (%) | γ + κ + 0.3μ − β + 500Pb (%) 18≧ | γ + κ + 0.3μ − β − 500Pb (%) ≦56 |
|---|---|---|---|---|---|---|---|---|---|---|
| 1 | α + γ + κ | 25 | 0 | 0 | 63.7 | 63.5 | 63.62 | 25 | — | — |
| 2 | α + γ + κ | 25 | 0 | 0 | 64.2 | 63.4 | 63.76 | 25 | 29.0 | 21 |
| | α + γ + κ | 25 | 0 | 0 | 64.2 | 63.4 | 63.76 | 25 | 29.0 | 21 |
| 3 | α + γ + κ | 25 | 0 | 0 | 64.0 | 62.7 | 63.3 | 25 | 31.5 | 18.5 |
| | α + γ + κ | 25 | 0 | 0 | 84.0 | 62.7 | 63.3 | 25 | 31.5 | 18.5 |
| 4 | α + γ + κ | 25 | 0 | 0 | 65.1 | 62.2 | 63.66 | 25 | — | — |
| 5 | α + γ + κ | 25 | 0 | 0 | 65.7 | 60.9 | 63.26 | 25 | — | — |
| 6 | α + γ + β | 15 | 3 | 0 | 62.3 | 62.1 | 62.15 | 12 | — | — |
| 7 | α + γ + β | 15 | 4 | 0 | 62.4 | 61.7 | 62.05 | 11 | 14.5 | 7.5 |
| 8 | α + γ + β | 15 | 2 | 0 | 62.4 | 61.2 | 61.84 | 13 | 19.0 | 7 |
| | α + γ + β | 15 | 1 | 0 | 62.4 | 61.2 | 61.84 | 14 | 20.0 | 8 |
| | α + γ + β | 15 | 5 | 0 | 62.4 | 61.2 | 61.84 | 10 | 16.0 | 4 |
| 9 | α + γ + κ + μ | 60 | 0 | 5 | 63.5 | 63.2 | 63.32 | 61.5 | 63.0 | — |

TABLE 2-continued

2nd, 3rd Invension alloys and comparative alloys

| | | | | | | | | | | |
|---|---|---|---|---|---|---|---|---|---|---|
| 10 | α + γ + κ + μ | 60 | 0 | 5 | 63.4 | 62.7 | 63.09 | 61.5 | 65.0 | 58 |
| | Heat treatment, 580° C. × 20 min | 55 | 0 | 2 | 63.4 | 62.7 | 63.09 | 55.6 | 59.1 | 52.1 |
| | α + γ + κ + μ | 55 | 0 | 10 | 63.4 | 62.7 | 63.09 | 58 | 61.5 | 54.5 |
| | α + γ + κ + μ | 55 | 0 | 3 | 63.4 | 62.7 | 63.09 | 55.9 | 59.4 | 52.4 |
| 11 | α + γ + κ | 30 | 0 | 0 | 64.6 | 63.8 | 64.19 | 30 | 34.0 | 26 |
| 12 | α + γ + β | 25 | 10 | 0 | 60.8 | 59.6 | 60.2 | 15 | 21.0 | 9 |
| 13 | α | 0 | 0 | 0 | 69.6 | 67.8 | 68.7 | 0 | 9.0 | −9 |
| 14 | α + γ + κ | 35 | 0 | 0 | 64.4 | 63.5 | 63.91 | 35 | 39.5 | 30.5 |
| 14B | α + γ + κ | 40 | 0 | 0 | 64.8 | 63.8 | 64.25 | 40 | 45.0 | 35 |
| 15 | α + γ + κ | 45 | 0 | 0 | 63.7 | 62.2 | 62.95 | 45 | 52.5 | 37.5 |
| 16 | α + γ + κ | 35 | 0 | 0 | 63.9 | 62.9 | 63.4 | 35 | 40.0 | 30 |
| 17 | α + γ + κ | 30 | 0 | 0 | 62.8 | 61.8 | 62.3 | 30 | 35.0 | 25 |
| 18 | α + γ + κ | 35 | 0 | 0 | 63.2 | 62.2 | 62.7 | 35 | 40.0 | 30 |
| 19 | α + γ + κ | 40 | 0 | 0 | 63.7 | 62.7 | 63.15 | 40 | 45.0 | 35 |
| 20 | α | 0 | 0 | 0 | 71.2 | 70.2 | 70.7 | 0 | 5.0 | −5 |
| 21 | α + β | 0 | 10 | 0 | 64.4 | 63.4 | 63.85 | −10 | −5.0 | −15 |
| 22 | α + γ + κ | 25 | 0 | 0 | 63.5 | 62.5 | 63 | 25 | 30.0 | 20 |
| 23 | α + γ + β | 20 | 10 | 0 | 61.6 | 60.6 | 61.1 | 10 | 15.0 | 5 |
| 24 | Heat treatment, 520° C. × 40 min | 25 | 3 | 0 | 61.6 | 60.6 | 61.1 | 22 | 27.0 | 17 |
| 25 | α + β | 0 | 5 | 0 | | | | | | |
| | | 0 | 10 | 0 | | | | | | |
| 26 | α + β | 0 | 20 | 0 | | | | | | |
| | | 0 | 25 | 0 | | | | | | |
| 27 | α + κ | 85 | 0 | 0 | | | | | | |
| 28 | α + δ | 0 | 0 | 0 | | | | | | |
| 29 | α + γ + β | 1 | 0 | 0 | | | | | | |
| 30 | α + β | 0 | 10 | 0 | | | | | | |
| | α + β | 0 | 15 | 0 | | | | | | |

| | Conditions of Chips 60 m/min | 120 m/min | 200 m/min | Cutting Force (N) 60 m/min | 120 m/min | 200 m/min | Condition of Chips Drilling 80 m/min | Tensile strength N/mm2 | Elongation % | Pb leaching, mg/L | ISO6509 Maxmium Corrosion Depth (μm) | Erosion corrosion, weight loss (mg) |
|---|---|---|---|---|---|---|---|---|---|---|---|---|
| 1 | ◎ | Δ | Δ | 105 | 129 | 141 | ◎ | | | | | |
| 2 | ◎ | ◎ | ○ | 101 | 103 | 112 | ◎ | 525 | 38 | | <10 | 50 |
| | ◎ | ◎ | ○ | 100 | 102 | 109 | ◎ | 426 | 28 | <0.001 | <10 | 55 |
| 3 | ◎ | ◎ | ◎ | 99 | 102 | 103 | ◎ | 527 | 37 | | <10 | |
| | ◎ | ◎ | ◎ | 98 | 99 | 104 | ◎ | 419 | 26 | 0.005 | <10 | |
| 4 | | | | | | | | | | 0.015 | | |
| 5 | | | | | | | | | | 0.023 | | |
| 6 | ▼ | ▼ | XX | 125 | 145 | 177 | ▼ | | | | | |
| 7 | ▼ | ▼ | ▼ | 124 | 138 | 147 | ▼ | 501 | 24 | | 80 | |
| 8 | ◎ | ○ | ○ | 114 | 118 | 130 | ◎ | 506 | 27 | | | |
| | ◎ | ○ | ○ | 113 | 119 | 127 | ◎ | 502 | 27 | | | |
| | ◎ | ▼ | X | 118 | 134 | 164 | ▼ | 405 | 20 | 0.004 | | |
| 9 | ○ | Δ | X | 117 | 147 | 171 | ▼ | 568 | 28 | | | |
| 10 | ◎ | Δ | Δ | 115 | 145 | 150 | ▼ | 565 | 28 | | 20 | |
| | ◎ | ○ | ○ | 112 | 119 | 124 | ◎ | 546 | 32 | | <10 | |
| | ○ | ○ | ○ | 114 | 122 | 129 | ◎ | 538 | 26 | | 30 | 45 |
| | ◎ | ○ | ○ | 109 | 116 | 122 | ◎ | 425 | 24 | | <10 | 45 |
| 11 | ● | ◎ | ◎ | 99 | 101 | 103 | ◎ | 528 | 30 | | <10 | 30 |
| 12 | Δ | X | X | 131 | 158 | 170 | ▼ | | | | 320 | |
| 13 | XX | XX | XX | 160 | 175 | 193 | XX | | | | 100 | |
| 14 | ● | ◎ | ○ | 99 | 101 | 106 | ◎ | 534 | 28 | | <10 | 20 |
| 14B | ◎ | ◎ | ◎ | 101 | 104 | 106 | ◎ | 542 | 34 | | <10 | 30 |
| 15 | ◎ | ◎ | ○ | 117 | 121 | 129 | ◎ | 635 | 22 | | | |
| 16 | ◎ | ◎ | ○ | 114 | 120 | 124 | ◎ | 658 | 20 | | | |
| 17 | ◎ | ○ | ○ | 112 | 124 | 127 | ◎ | 565 | 26 | | | 20 |
| 18 | ◎ | ○ | ○ | 113 | 125 | 129 | ◎ | | | | 20 | |
| 19 | ◎ | ○ | ○ | 112 | 123 | 128 | ◎ | 611 | 26 | | | |
| 20 | XX | XX | XX | 188 | 204 | 222 | XX | | | | | |
| 21 | XX | XX | XX | 175 | 200 | 215 | XX | | | | | |
| 22 | ○ | ○ | ○ | 110 | 115 | 129 | ▼ | | | | | |
| 23 | Δ | X | X | 130 | 155 | 171 | XX | 494 | 12 | 0.008 | | |
| 24 | ◎ | ○ | ○ | 111 | 124 | 128 | ◎ | 523 | 20 | 0.004 | | |
| 25 | ● | ● | ● | 86 | 87 | 90 | ● | 402 | 34 | | 1000 | 130 |
| | | | | | | | | | | 0.35 | | |
| 26 | ● | ● | ◎ | 94 | 95 | 101 | ◎ | 413 | 36 | | 900 | 140 |
| | | | | | | | | | | 0.29 | | |

TABLE 2-continued

| 2nd, 3rd Invension alloys and comparative alloys | | | | | | | | | | | | |
|---|---|---|---|---|---|---|---|---|---|---|---|---|
| 27 | ▼ | X | X | 130 | 147 | 172 | ▼ | 488 | 22 | 0.004 | 120 | 50 |
| 28 | ● | ◎ | ◎ | 91 | 97 | 105 | ● | 225 | 19 | 0.39 | <10 | 20 |
| 29 | ◎ | ○ | ▼ | 105 | 118 | 129 | ◎ | 322 | 34 | 0.21 | 600 | 110 |
| 30 | XX | XX | X | 194 | 201 | 208 | XX | 352 | 46 | 0.006 | 850 | |

*Conventional Comparative Alloys:
no. 25 JIS: C3604 CDA: C36000
no. 26 JIS: C3771 CDA: C37700
no. 27 JIS: CAC802 CDA: C87500
no. 28 JIS: CAC203 CDA: C85700
no. 29 JIS: CAC406 CDA: C83600
no. 30 JIS: C2800 CDA: C28000
Forms of the chips represented by:
◎ Arch or Circular arch
○ Rectangular (length: <25 mm)
● Needle
▼ Rectangular (length: 25–75 mm)
Δ Spiral with 1–3 windings
X Rectangular (length: >75 mm)
XX Spiral with >3 windings

What is claimed is:

1. A free-cutting copper alloy, consisting essentially of 71.5 to 78.5 percent, by weight, of copper; 2.0 to 4.5 percent, by weight, of silicon; 0.005 percent and up to but less than 0.02 percent, by weight, of lead; and a remaining percentage, by weight, of zinc, wherein the percent by weight of copper and silicon in the copper alloy satisfy the relationship $$61-50\text{Pb} \leqq X-4Y \leqq 66+50\text{Pb},$$

wherein

Pb is the percent, by weight, of lead,

X is the percent, by weight, of copper, and

Y is the percent, by weight, of silicon, wherein each of the following additional relationships are satisfied:

α phase of about 30% or more of the total phase area of the alloy;

0%≦β phase≦5% of the total phase area of the alloy;

0%≦μ phase≦20% of the total phase area of the alloy; and 18-500(Pb) %≦κ phase+γ phase+0.3(μ phase)−β phase≦56+500(Pb) % of the total phase area of the alloy.

2. A free-cutting copper alloy, consisting essentially of 71.5 to 78.5 percent, by weight, of copper; 2.0 to 4.5 percent, by weight, of silicon; 0.005 percent and up to but less than 0.02 percent, by weight, of lead; at least one element selected from among 0.01 to 0.2 percent, by weight, of phosphorous, 0.02 to 0.2 percent, by weight, of antimony, 0.02 to 0.2 percent, by weight, of arsenic, 0.1 to 1.2 percent, by weight, of tin, and 0.1 to 2.0 percent, by weight, of aluminum; and a remaining percentage, by weight, of zinc, wherein the percent by weight of copper and silicon in the copper alloy satisfies the relationship $$61-50\text{Pb} \leqq X-4Y+aZ \leqq 66+50\text{Pb},$$

wherein

Pb is the percent, by weight, of lead,

X is the percent, by weight, of copper,

Y is the percent, by weight, of silicon, and

Z is the amount a selected element from among phosphorous, antimony, arsenic, tin and aluminum, and a is a coefficient of the selected element, wherein a is −3 when the selected element is phosphorous, a is 0 when the selected element is antimony, a is 0 when the selected element is arsenic, a is −1 when the selected element is tin, and a is −2 when the selected element is aluminum, wherein each of the following additional relationships are satisfied:

α phase of about 30% or more of the total phase area of the alloy;

0%≦β phase ≦5% of the total phase area of the alloy;

0%≦μ phase≦20% of the total phase area of the alloy; and 18-500(Pb) %≦κ phase+γ phase+0.3(μ phase)−β phase≦56+500(Pb) % of the total phase area of the alloy.

3. A free-cutting copper alloy, consisting essentially of 71.5 to 78.5 percent, by weight, of copper; 2.0 to 4.5 percent, by weight, of silicon; 0.005 percent and up to but less than 0.02 percent, by weight, of lead; at least one element selected from among 0.01 to 0.2 percent, by weight, of phosphorous, 0.02 to 0.2 percent, by weight, of antimony, 0.02 to 0.15 percent, by weight, of arsenic, 0.1 to 1.2 percent, by weight, of tin, and 0.1 to 2.0 percent, by weight, of aluminum; at least one element selected from among 0.3 to 4 percent, by weight, of manganese, and 0.2 to 3.0 percent, by weight, of nickel so the total percent, by weight, of manganese and nickel is between 0.3 to 4.0 percent, by weight; and a remaining percentage, by weight, of zinc, wherein the percent by weight of copper and silicon in the copper alloy satisfies the relationship $$61-50\text{Pb} \leqq X-4Y+a_1Z_1+a_2Z_2 \leqq 66+50\text{Pb},$$

wherein

Pb is the percent, by weight, of lead,

X is the percent, by weight, of copper,

Y is the percent, by weight, of silicon, and $Z_1$ is the amount of a selected element from among phosphorous, antimony, arsenic, tin, and aluminum, and $Z_2$ is the amount of a selected element from among manganese and nickel, and $a_1$ is a coefficient of the selected element from among phosphorous, antimony, arsenic, tin, and aluminum, wherein $a_1$ is −3 when phosphorous is selected, $a_1$ is 0 when antimony is selected, $a_1$ is 0 when arsenic is selected, $a_1$ is −1 when tin is selected, and $a_1$ is −2 when aluminum is selected, and $a_2$ is a coefficient of the selected element from among manganese, and nickel, wherein $a_2$ is 2.5 when manganese is selected, and $a_2$ is 2.5 when nickel is selected, wherein each of the following additional relationships are satisfied:

α phase of about 30% or more of the total phase area of the alloy;

0%≦β phase≦5% of the total phase area of the alloy;

0%≦μ phase≦20% of the total phase area of the alloy; and 18-500(Pb) %≦κ phase+γ phase+0.3(μ phase)−β phase>56+500(Pb) % of the total phase area of the alloy.

4. A free-cutting copper alloy according to claim 1, wherein the alloy includes at least one element selected from the group consisting of 0.01 to 0.2 percent, by weight, of bismuth, 0.03 to 0.2 percent, by weight, of tellurium, and 0.03 to 0.2 percent, by weight, of selenium.

5. A free-cutting copper alloy according to claim 1, wherein the alloy contains no more than 0.5 percent, by weight, of iron as an impurity.

6. A free-cutting copper alloy according to claim 1, wherein the alloy is made by a process comprising the step of subjecting the alloy to a heat treatment for 20 minutes to 6 hours at 460° C. to 600° C.

7. A free-cutting copper alloy according to claim 2, wherein the alloy includes at least one element selected from the group consisting of 0.01 to 0.2 percent, by weight, of bismuth, 0.03 to 0.2 percent, by weight, of tellurium, and 0.03 to 0.2 percent, by weight, of selenium.

8. A free-cutting copper alloy according to claim 3, wherein the alloy includes at least one element selected from the group consisting of 0.01 to 0.2 percent, by weight, of bismuth, 0.03 to 0.2 percent, by weight, of tellurium, and 0.03 to 0.2 percent, by weight, of selenium.

9. A free-cutting copper alloy according to claim 2, wherein the alloy contains no more than 0.5 percent, by weight, of iron as an impurity.

10. A free-cutting copper alloy according to claim 3, wherein the alloy contains no more than 0.5 percent, by weight, of iron as an impurity.

11. A free-cutting copper alloy according to claim 4, wherein the alloy contains no more than 0.5 percent, by weight, of iron as an impurity.

12. A free-cutting copper alloy according to claim 2, wherein the alloy is made by a process comprising the step of subjecting the alloy to a heat treatment for 20 minutes to 6 hours at 460° C. to 600° C.

13. A free-cutting copper alloy according to claim 3, wherein the alloy is made by a process comprising the step of subjecting the alloy to a heat treatment for 20 minutes to 6 hours at 460° C. to 600° C.

14. A free-cutting copper alloy according to claim 4, wherein the alloy is made by a process comprising the step of subjecting the alloy to a heat treatment for 20 minutes to 6 hours at 460° C. to 600° C.

15. A free-cutting copper alloy according to claim 5, wherein the alloy is made by a process comprising the step of subjecting the alloy to a heat treatment for 20 minutes to 6 hours at 460° C. to 600° C.

16. A free-cutting copper alloy, consisting of 71.5 to 78.5 percent, by weight, of copper; 2.0 to 4.5 percent, by weight, of silicon; 0.005 percent and up to but less than 0.02 percent, by weight, of lead; and a remaining percentage, by weight, of zinc, wherein the percent by weight of copper and silicon in the copper alloy satisfy the relationship $$61-50\mathrm{Pb} \leqq X-4Y \leqq 66+50\mathrm{Pb},$$

wherein

Pb is the percent, by weight, of lead,

X is the percent, by weight, of copper, and

Y is the percent, by weight, of silicon, wherein each of the following additional relationships are satisfied:

α phase of about 30% or more of the total phase area of the alloy;

0%≦β phase≦5% of the total phase area of the alloy;

0%≦μ phase≦20% of the total phase area of the alloy; and 18-500(Pb) %≦κ phase+γ phase+0.3(μ phase)−β phase≦56+500(Pb) % of the total phase area of the alloy.

* * * * *